US010531747B1

(12) United States Patent
Stravitz

(10) Patent No.: US 10,531,747 B1
(45) Date of Patent: Jan. 14, 2020

(54) MOVEMENT LIMITING SYSTEM FOR BABY WALKERS

(71) Applicant: Dooli Products, LLC, New York, NY (US)

(72) Inventor: David M Stravitz, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 16/583,850

(22) Filed: Sep. 26, 2019

Related U.S. Application Data

(63) Continuation-in-part of application No. 16/446,186, filed on Jun. 19, 2019, now Pat. No. 10,463,169.

(51) Int. Cl.
*A47D 13/04* (2006.01)
*A47D 15/00* (2006.01)
*A61H 3/00* (2006.01)

(52) U.S. Cl.
CPC ..... *A47D 15/006* (2013.01); *A47D 13/043* (2013.01)

(58) Field of Classification Search
CPC .... A47D 13/00; A47D 13/045; A47D 13/046; A61H 3/00; A61H 1/0262; A61H 2201/1652; A63B 21/4034; A63B 22/20
USPC ..... 472/14–15; 482/66–69, 148; 280/87.05
See application file for complete search history.

(56) References Cited

U.S. PATENT DOCUMENTS 368,477 A * 8/1887 Vanetten ..... A47D 13/107 297/274
671,058 A 4/1901 Resetar
821,116 A 5/1906 Nunamaker
903,731 A 11/1908 Kull
1,297,800 A 3/1919 Cranford
D119,382 S 3/1940 De Puy
2,352,450 A 6/1944 Reinholz
3,721,437 A 3/1973 Skaricic
3,030,587 A 5/1973 Bloxham et al.
5,371,922 A 12/1994 Chern et al.
5,409,246 A 4/1995 Ali
5,409,437 A 4/1995 Lauro et al.
5,727,800 A 3/1998 Liu
5,728,030 A 3/1998 Hsieh
5,833,316 A 11/1998 Hseih
6,048,290 A 4/2000 Chen et al.
6,093,024 A 7/2000 Sokolowski
(Continued)

OTHER PUBLICATIONS

Carolyn L. Todd, Baby Walkers Cause Thousands of ER Visits Every Year, Experts Warn, www.self.com, Sep. 26, 2018.
(Continued)

*Primary Examiner* — Kien T Nguyen
(74) *Attorney, Agent, or Firm* — Brian Roffe

(57) ABSTRACT

Movement limiting system for a walker that limits movement of the walker includes an elongate, adjustable length armature having first and second opposite end regions and a coupler that couples the first end region of the armature to the walker. When the second end region of the armature is coupled to an object, the walker is limited in its movement relative to the object by the armature. The second end region of the armature includes attachment structure that couples the armature to the object. The armature preferably includes multiple sections that telescope relative to one another to provide the armature with its adjustable length.

20 Claims, 17 Drawing Sheets

(56) References Cited

U.S. PATENT DOCUMENTS

| | | | |
|---|---|---|---|
| 6,352,234 | B1 | 3/2002 | Liu |
| 7,055,836 | B2 | 6/2006 | Cheng |
| 7,097,599 | B2 | 8/2006 | Gates |
| 7,247,100 | B2 | 7/2007 | Jackson et al. |
| 7,507,162 | B2 | 3/2009 | Jackson et al. |
| 9,107,513 | B2 | 8/2015 | Asfa |

OTHER PUBLICATIONS

Injuries Associated With Infant Walkers, Committee on Injury and Poison Prevention, Pediatrics 2001;108;790.

* cited by examiner

MOVEMENT LIMITING SYSTEM FOR BABY WALKERS

CROSS-REFERENCE TO RELATED APPLICATION

This application is a continuation-in-part of U.S. patent application Ser. No. 16/446,186 filed Jun. 19. 2019, which is incorporated by reference herein.

FIELD OF THE INVENTION

The present invention relates generally to learn-to-walk systems including a baby walker and more specifically to learn-to-walk systems including baby walkers that have improved safety features relative to a significant number of existing baby walkers notably in that the range of movement of the baby walkers are limited while still providing for full functionality of the baby walker.

The present invention also relates to a movement limiting system that is used in conjunction with an existing baby walker and imposes movement limitations on the conventional baby walker. This movement limiting system may be in the form of a retrofit kit that is provided independent of the baby walker.

The present invention also relates to baby walkers that provide a wide range of movement to toddlers using the baby walkers.

The present invention also relates to learn-to-walk systems including baby walkers that are used with walking wings for toddlers at stages approaching unassisted walking.

BACKGROUND OF THE INVENTION

From 1990-2014, there were about 230,676 reported injuries arising from baby walker related usage. A whopping 74% were from babies in walkers falling down stairs and injuring themselves. One inescapable conclusion is that a major hazard of baby walkers is the possibility of a user, i.e., a baby or toddler learning to walk, approaching and going down stairs.

Since 2014, this hazard has been reduced, for example, as a result of the elimination of wheels from some walker and constructing alternative walking learning devices to be immobile (rendering them non-walkers of sorts) or widening the walkers so they are prevented from passing through the width of doors or staircases. Still, over 2,000 baby walker related injuries are reported annually. To this inventor, that's an unfortunate 2,000 more baby walker related injuries than should be tolerated.

According to an article in the American Academy of Pediatrics, Committee on Injury and Poison Prevention, entitled, Injuries Associated With Infant Walkers, Pediatrics 2001;108;790, in 1999, an estimated 8800 children younger than 15 months were treated in hospital emergency departments in the United States for injuries associated with infant walkers. Thirty-four infant walker-related deaths were reported from 1973 through 1998. The vast majority of injuries occur from falls down stairs, and head injuries are common. The use of warning labels, public education, adult supervision during walker use, and stair gates have all been demonstrated to be insufficient strategies to prevent injuries associated with infant walkers.

To comply with the revised voluntary standard (ASTM F977-96), walkers manufactured after Jun. 30, 1997, must be wider than a 36-in doorway or must have a braking mechanism designed to stop the walker if one or more wheels drop off the riding surface, such as at the top of a stairway. This standard is voluntary and often not followed since most walkers are ideally less than 36 inches wide. A walker wider than 36 inches is simply overly large.

Because data indicate a considerable risk of major and minor injury and even death from the use of infant walkers, and because there is no clear benefit from their use, the American Academy of Pediatrics recommends a ban on the manufacture and sale of mobile infant walkers. If a parent insists on using a mobile infant walker, it is vital that they choose a walker that meets the performance standards of ASTM F977-96 to prevent falls down stairs.

A web article in Health, dated Sep. 26, 2018 by Carolyn L. Todd, entitled "Baby Walkers Cause Thousands of ER Visits Every Year, Experts Warn", also discusses this issue and refers to the American Academy of Pediatrics study.

As used in the field to which this invention pertains, a baby walker is a device that seats or supports an infant, a child learning to walk or a toddler (hereinafter referred to as a toddler) into a central area suspended from a platform having a tray whereby the height of the platform is adjustable so that the toddler, whose has yet to learn to walk, has his or her feet reach the floor and just touch the floor. One common embodiment has four casters on a base that supports the platform and which casters engage with the floor to enable the toddler to move freely around the floor of the given environment, e.g., a room. Other walkers have more than four casters. Some walkers have two rotatable casters in the front of the base with two fixed trailing casters in the rear of the base. Others may have rotatable casters on all four sides of the base or distributed equiangularly around a circular base. The toddler can move freely once they are familiar with the walker. An unfortunate result of such construction is that there is almost no limit to where the toddler may go once they master the manner for moving the walker, other than the restrictions and limits of their environment.

Walkers of such types on the market include the Baby Einstein Caterpillar & Friends Discovery Walker, the Safety 1st Ready, Set, Walk! walker, and the Chicco Walky Talky Baby Walker. Each of these walkers, as well as other walkers on the market, does not have a built-in mechanism to control where a toddler may walk, or other limitation on the movement of the walker. Moving at a rate of about four feet per second, a toddler using a walker can move quickly into a potentially injurious situation.

It is therefore advisable that a parent or caregiver be extremely vigilant while a toddler is using a baby walker so as to avoid toddlers from moving out of sight or heading to what might be a dangerous situation (down a staircase, into a step, against a hot stove, etc.). In a fleeting second, serious injury can occur in the absence of adult oversight. Indeed, annually, thousands of reported injuries are caused by these baby walkers and some range from minor to serious—even fatal injuries.

OBJECTS AND SUMMARY OF THE INVENTION

It is an object of at least one embodiment of the invention to provide a learn-to-walk system including a baby walker that has an attachment to a wall or floor that limits where a toddler using the baby walker can move. To the inventor's knowledge, there are no commercial baby walkers with such an attachment of the type disclosed herein.

It is another object of at least one embodiment of the present invention to provide an attachment system that attaches to an existing baby walker and imposes movement limitations on the conventional baby walker.

It is another object of at least one embodiment of the present invention to provide a baby walker that can make a complete U-turn without the wheels or casters forming a wide stance radius. To the inventor's knowledge, there are no commercial baby walkers with such the ability to make a complete U-turn in this manner of the type disclosed herein.

It is yet another object of at least one embodiment of present invention to provide a learn-to-walk system including a baby walker that imposes parent or caregiver-determined limits on movement of the toddler using the baby walker so that it is possible to limit possible movement of the walker based on the environment of use.

It is yet another object of at least one embodiment of present invention to provide a learn-to-walk system including a baby walker that is limited in its movement so that a toddler using the baby walker is unable to exceed such limits.

It is yet another object of at least one embodiment of present invention to provide a learn-to-walk system including a baby walker that provides an expandable extension (with adjustable limited extension parameters) to define a variable, maximum area of use of the baby walker.

In order to achieve at least one of these objects and/or one or more other objects, a movement limiting system for a walker that limits movement of the walker in accordance with the invention includes an elongate, adjustable length armature having first and second opposite end regions and coupling means for coupling the first end region of the armature to the walker. When the second end region of the armature is coupled to an object, the walker is limited in its movement relative to the object by the armature. Attachment means may be provided at the second end region of the armature for coupling the armature to the object. The armature preferably includes a plurality of sections that telescope relative to one another to provide the armature with its adjustable length.

In one embodiment, the coupling means comprise a coupler that surrounds a support portion of the walker. The coupler includes an anchor element having a projection and a clip connecting the projection to the first end region of the armature. The clip may be removable from engagement with the projection and with the first end region of the armature. The coupler could also include a buckle, a strap having a first end region engaging with the buckle and a second end region opposite the first end region engaging with the buckle. The buckle has an open state in which the strap is positionable around the support portion and a closed state in which the strap is secured around the support portion. The anchor element is secured to the strap in a position on a top or outer side of the support portion when the buckle is in the closed state.

In an alternative embodiment, the coupling means include a clasp component having a first clasp configured to engage with an axle, wheel, support or pivot pin of the walker and a second clasp configured to engage with the first end region of the armature. In one embodiment, the system includes a stand including a base and a pole extending upward from the base, the stand constituting the object, and a ring or loop at the second end region of the armature and that engages with the pole to secure the armature to the pole. Alternatively, the system includes a bracket attachable to a wall, the wall constituting the object, and a ring or loop at the second end region of the armature and that engages with the bracket to secure the armature to the wall.

A variant of the movement limiting system for a walker that limits movement of the walker in accordance with the invention includes an elongate, adjustable length armature having first and second opposite end regions, a coupler that surrounds a support portion of the walker and couples the first end region of the armature to the walker, and attachment means at the second end region of the armature for coupling the armature to an object. When the second end region of the armature is coupled to the object, the walker is limited in its movement relative to the object by the armature.

A kit for a walker to limit movement of the walker in accordance with the invention includes an elongate, adjustable length armature having first and second opposite end regions, a coupler that surrounds a support portion of the walker and couples the first end region of the armature to the walker, a bracket attachable to a wall, and a ring or loop at the second end region of the armature and that engages with the bracket to secure the armature to the wall. When the second end region of the armature is coupled to the wall, the walker is limited in its movement relative to the wall by the armature.

In accordance with another embodiment of the invention, a learn-to-walk system including a baby walker in accordance with the invention generally includes a toddler retainer for retaining or supporting a toddler, a substrate support for supporting the toddler retainer while allowing rotation of the toddler retainer relative to the substrate support and movement of the baby walker on a substrate, and an adjustable armature having two attachment mechanisms, one at an end region coupled to the toddler retainer or to substrate support and another at the opposite end region. The attachment mechanism at the end region coupled to the toddler retainer or the substrate support is configured to allow swiveling of the toddler retainer or the substrate support relative to the armature, while the attachment mechanism at the other end region is configured to be fixed to a stationary object. Examples of stationary objects to which the other end region may be fixed include a wall or other vertical support structure such as a pole, with the end region being freely rotational or limited in its rotation about the vertical support structure depending on the type of vertical support structure.

Adjustability of the armature may be provided by constructing the armature as a fluid adjustable telescoping armature. The substrate support typically includes caster assemblies having wheels to allow for movement on the substrate.

The substrate support may be separated from the toddler support by one or more bearings so that the toddler support can freely rotate 360 degrees relative to the substrate support, e.g., the substrate support being or including a first rim or ring of a cooperating bearing assembly while the toddler support is or includes the second rim or ring of the cooperating bearing assembly. This 360 degree movement may be achieved while the caster assemblies of the walker remain in stationary positions. The armature is thus attached to the first rim or ring holding this rim or ring in position while the second rim or ring rotates relative thereto.

In the learn-to-walk system including a baby walker that is used in combination with "walking wings", commonly considered to be a padded-support vest that securely fastens around a baby's chest and has two adjustable straps for parents to hold while baby learns to walk, the toddler retainer includes a base, an upper support rim, at least one support that supports the upper support rim a distance above the base, and a retaining structure attached to or formed integral with the upper support rim. The retaining structure is configured to secure a harness or handle of the walking wings.

This walker optionally includes a positioning member having a first end region adjustably attached to the upper support rim at a first location and a second end region adjustably attached to the upper support rim at a second location to thereby define two apertures between the positioning member and the upper support rim through which the legs of the toddler using the baby walker pass. The toddler is thereby supported, if needed, on the positioning member. The positioning member is preferably as soft, preferably plush cushion that prevents the toddler from falling inward, and is also preferably washable as it might be subject to be sullied by the toddler.

To secure the harness or handle of the walking wings to the retaining structure, one or more clamps are attached to the retaining structure and clamp the harness or handle of the walking wings. In one embodiment, the retaining structure includes an elevated bar portion, support portions that elevate the bar portion above the upper support rim and at least one clamp configured to clamp the harness or handle of the walking wings. Also, the retaining structure may have an adjustable height.

Variations in the use of the system are possible. For example, if a parent decides to forgo the use of the clamps to secure the harness or handle, they can direct the walker themselves by grasping the harness or handle around the height bar portion adjusted to a desired height for comfort. This enables the parent to turn the toddler more freely.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
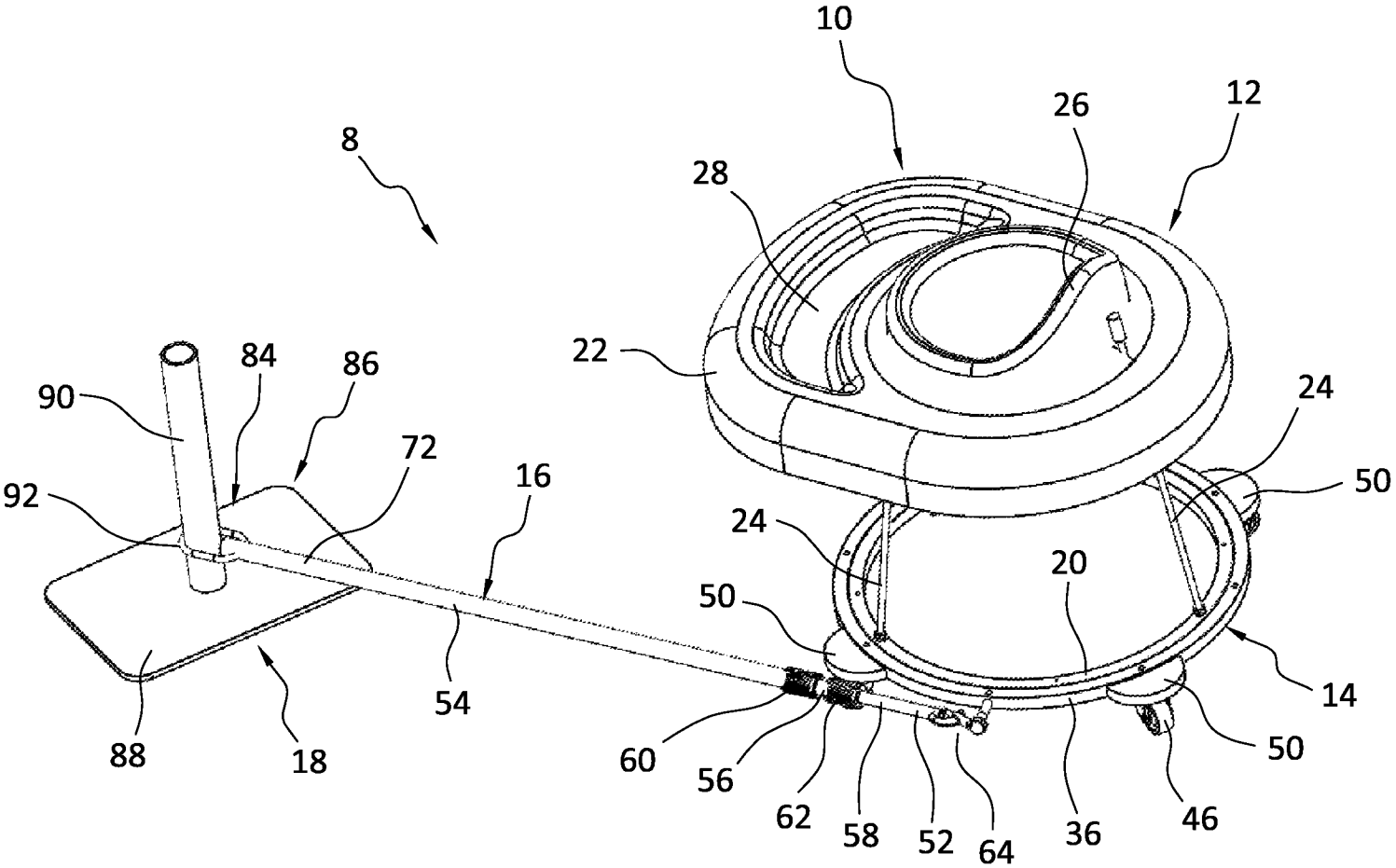
FIG. 1 is a front perspective view of a first embodiment of a learn-to-walk system including a baby walker in accordance with the invention.
Figure 2:
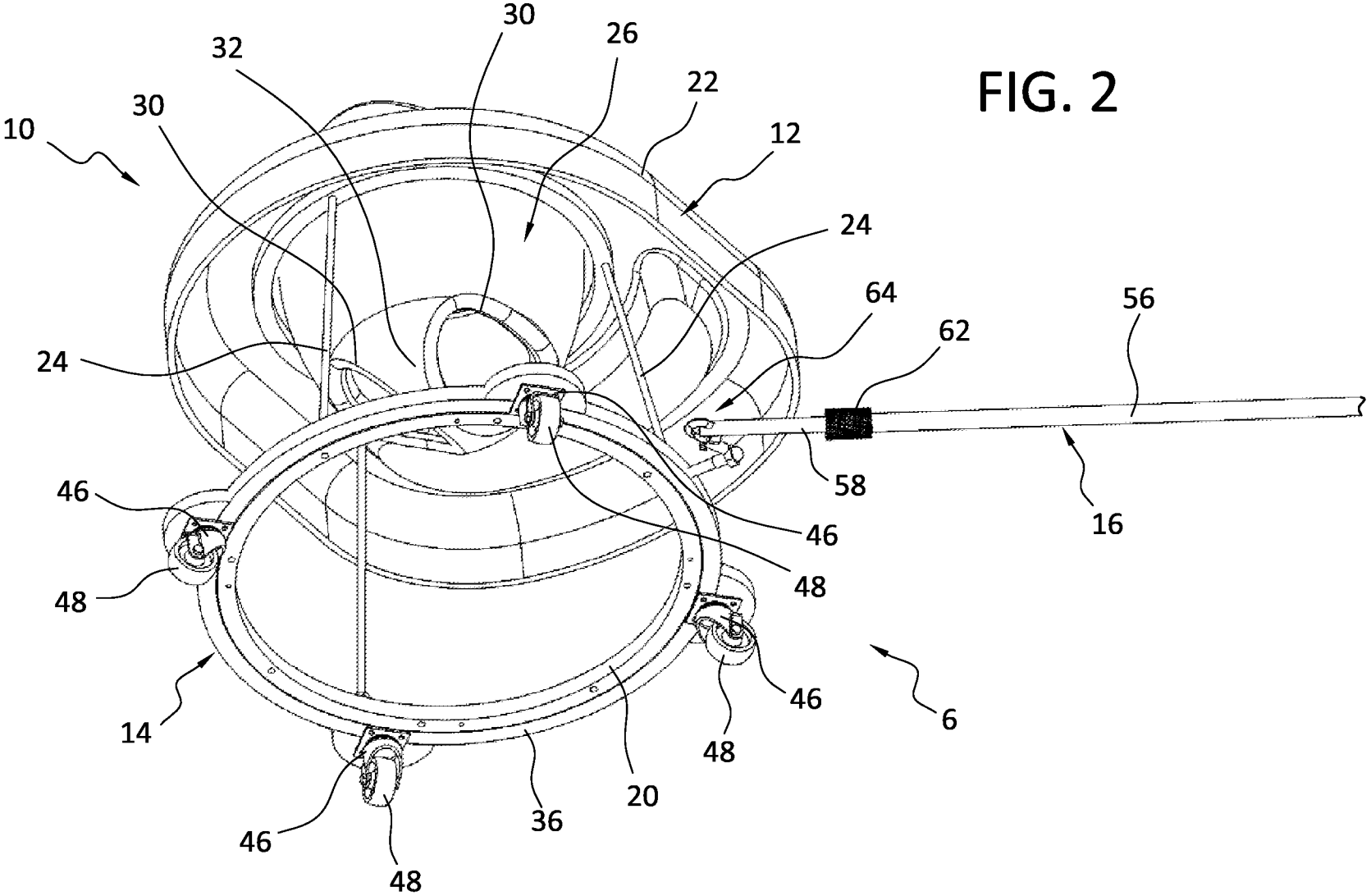
FIG. 2 is a bottom perspective view of the embodiment shown in FIG. 1.

Referring to the accompanying drawings wherein like reference numbers refer to the same or similar elements, FIGS. 1 and 2 show an embodiment of a learning-to-walk or learn-to-walk system 8 in accordance with the invention. System 8 is intended for use by a baby, a toddler, an infant, a child or any other person who may be learning to walk. This use by a person, which hereinafter will be generally referred to as a toddler, is not intended to limit the use of the system or the scope of the claims, and it is contemplated that the system and parts thereof, namely, a walker, may have other uses not limited to use for a toddler learning to walk.

System 8 includes a toddler retainer 12 for retaining or supporting the toddler, a substrate support 14 for supporting the toddler retainer 12 while allowing rotation of the toddler retainer 12 relative to the substrate support 14 and which substrate support 14 is configured for movement on a substrate such as a floor, and an elongate, preferably length-adjustable, armature 16 mounted at one end region to the substrate support 14 and which can be mounted at an opposite end region to a fixed-in-position or otherwise stationary object 18.

The toddler retainer 12 and substrate support 14 in combination may be considered in combination a walker 10. Such a walker 10 is also considered to be an invention herein.

Figure 8:
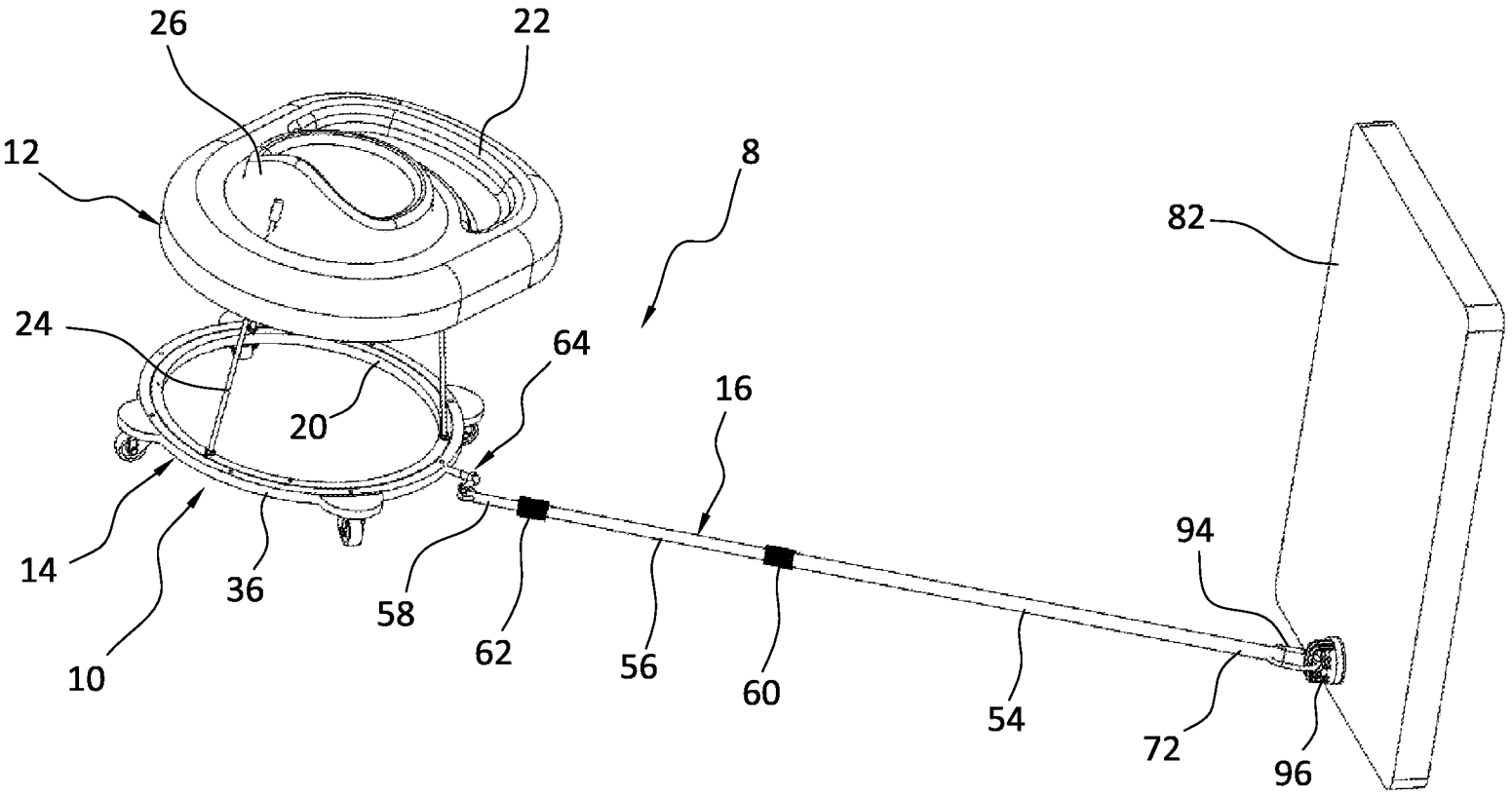
FIG. 8 is a front perspective view of the embodiment shown in FIG. 1 wherein the telescoping armature is connected to a wall instead of to a stand.

Stationary object 18 may be a stand as shown in FIG. 1, a wall as shown in FIG. 8, or any other object that is either fixed in position or can be made stationary. To optimize and maximize advantages of the invention, the object 18 should not move during use of the system 8 so that walker 10 is limited in its range of movement relative to the object 18. However, it is conceivable that the object 18 is movable, e.g., when the walker is moved to another location for use or placed into storage. During use, though, the object 18 should be fixed in a single position.

Toddler retainer 12 retains or supports the toddler by providing a component on which the toddler is able to rest or sit with their legs dangling below them. To this end, the toddler retainer 12 generally includes a base 20, a platform 22, one or more supports 24 that support the platform 22 a distance above the base 20, and a seat 26 attached to the platform 22. Retaining is thus used to connote that the toddler retainer 12 provides some structure that prevents the toddler from falling through an aperture in the platform 22. This structure may be the seat 26 on which the toddler sits or since it is possible that the toddler will not actually sit while using the walker 10, a strip of material that spans the aperture and defines two apertures for the toddler's legs and thus prevents the toddler from falling since their buttocks would contact the material strip if their feet lose traction. Any other type of positioning member that positions the toddler on the platform 22 may also be used in the invention.

Base 20 is circular in the illustrated embodiment but may have different shapes. Base 20 does not have to be a continuous base but may have discrete sections supporting each of the supports 24. At a minimum, only a portion of the base 20 should be arcuate or circular to enable rotation. The base 20 should define an aperture inward of its inner circumferential surface through which the legs or feet of the toddler pass to contact the substrate on which the baby walker 10 moves, e.g., a floor. Base 20 may be made of a rigid material, e.g., from a rigid plastic or metal.

Platform 22 can have a variety of different forms and shapes and often defines a tray area 28 into which toys, food and other substances can be placed to allow the toddler to play with them while in the toddler retainer 12. Platform 22 may be made of a plastic material, as is common in this field.

Supports 24 are preferably rigid and maintain the height of the platform 22 above the base 20. Often, the supports 24 are adjustable to accommodate different height toddlers. Such adjustable supports 24 are encompassed within the scope and spirit of the invention. Supports 24 may be made of metal or plastic.

Seat 26 is typically suspended from the underside of the platform 22 and defines two apertures 30 with a middle section 32 therebetween (see FIG. 2). In use, the toddler is placed so that their feet pass through the apertures 30 and their buttocks rest on the middle portion 32.

This structure of the seat 26 is not intended to limit the invention and any other seat or buttock support may be used. Such seats and buttock supports may be cushioned and made of a cleanable material Toddler retainer 12 is freely rotatable relative to the substrate support 14, e.g., capable of 360 degree turns while the substrate support 14 remains stationary. This is achieved in any number of different ways by a number of different structures, including structure known to those skilled in the art of relative rotation systems and bearings. In the illustrated embodiment, the outer surface of the base 20 is provided with a circumferential groove, channel or track 34 and a corresponding base 36 of the substrate support 14 is provided with a circumferential groove, channel or track 38 aligning with track 34 (see FIG. 3).

Bearings 40, or a race, are placed into the aligning tracks 34, 38 and enable the base 20 of the toddler retainer 12 to rotate relative to the base 36 of the substrate support 14 and thus the toddler retainer 12 to rotate 360 degrees relative to the substrate support 14. Bearings 40 may comprise round balls that are trapped in the aligning tracks 34, 38 between the bases 20, 36. This rotation can be seen in FIG. 4 which shows the baby walker 10 as shown in FIG. 3 with the toddler retainer 12 rotated counterclockwise relative to the substrate support 14.

Figure 3:
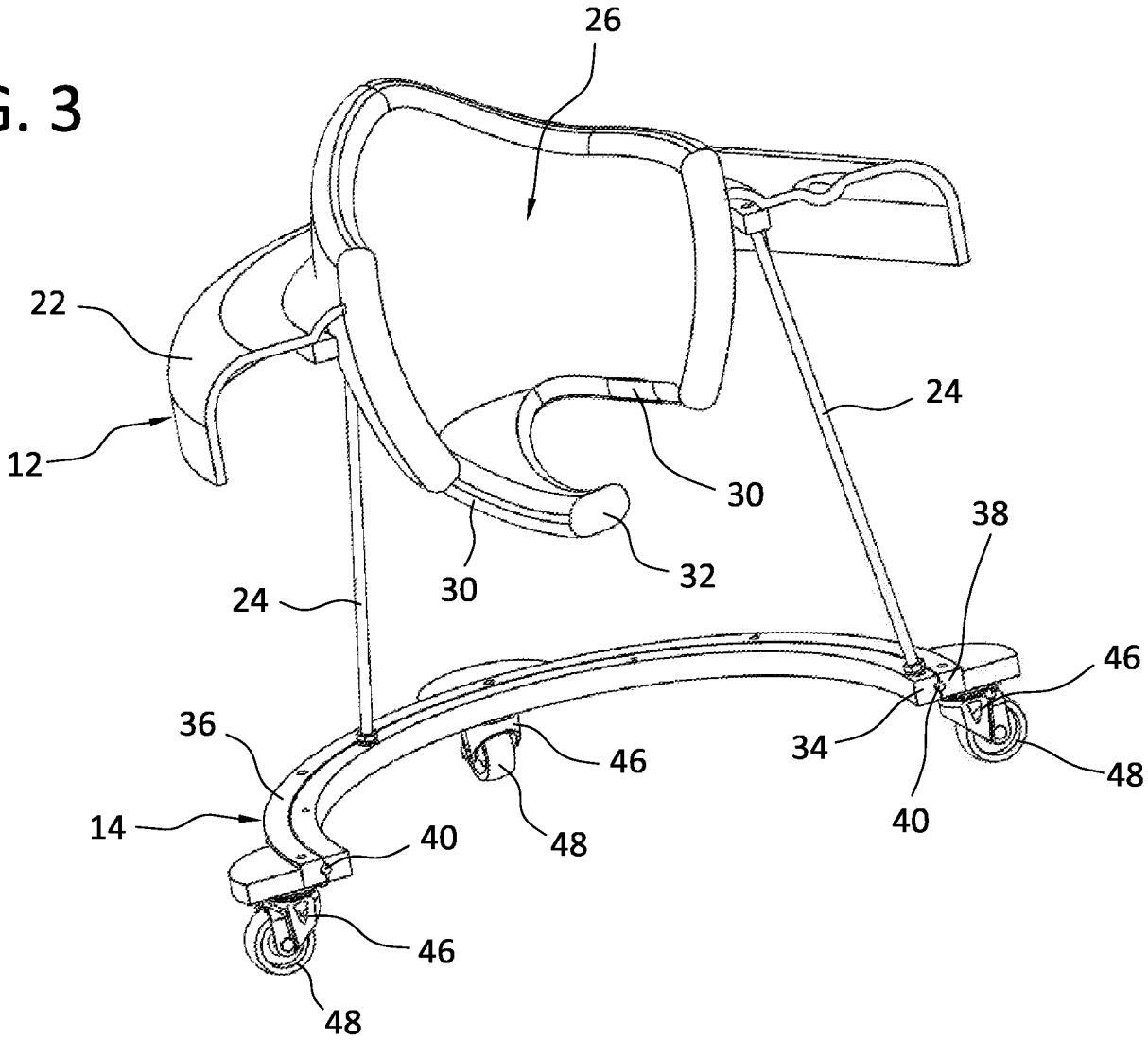
FIG. 3 is a cross-sectional view of the baby walker shown in FIG. 1 without the armature.
Figure 4:
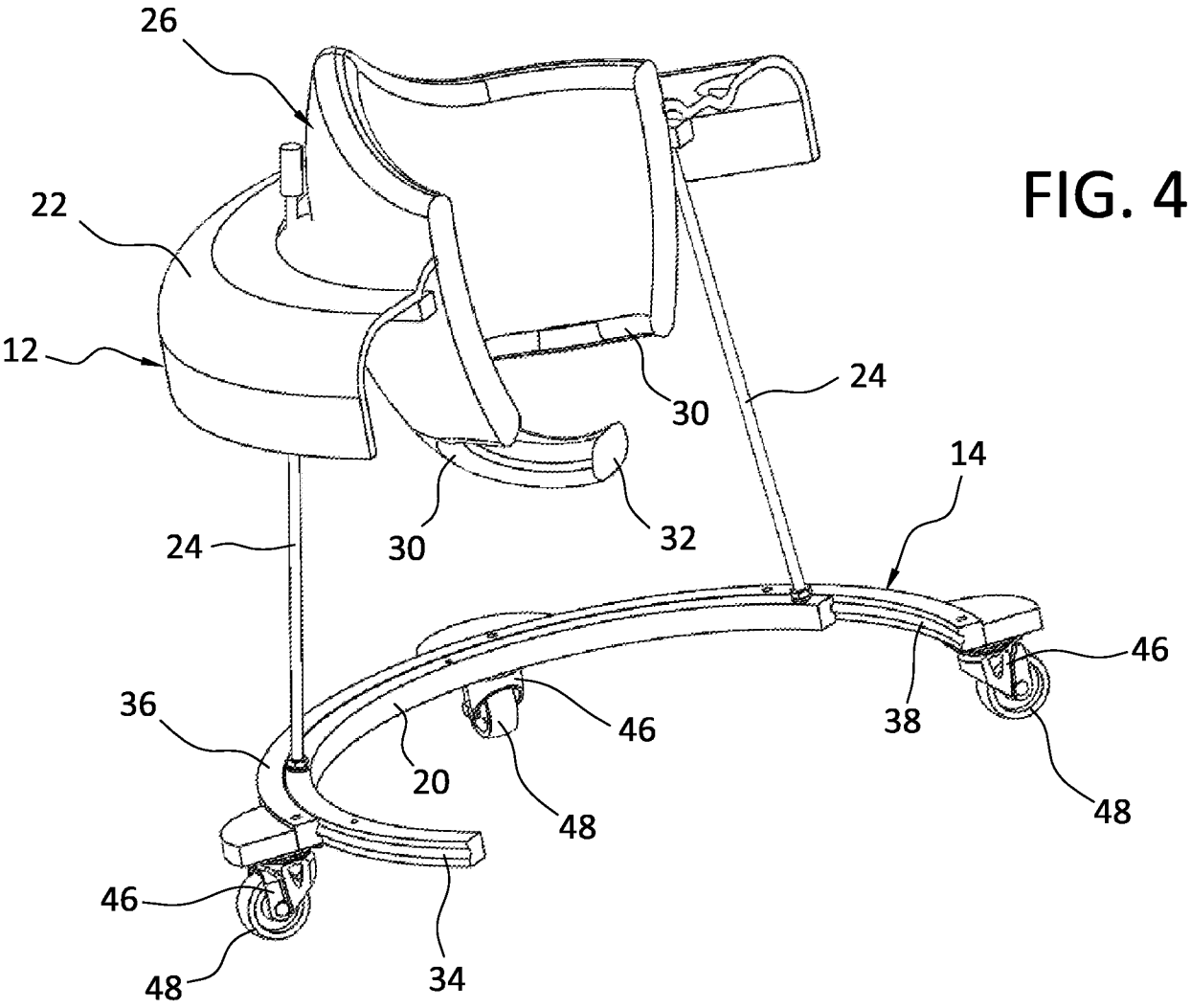
FIG. 4 is another cross-sectional view of the baby walker shown in FIG. 1 showing the toddler retainer rotated relative to the substrate support from the position shown in FIG. 3.

As seen in FIGS. 3 and 4, the base 20 has an inner cylindrical surface defining the opening through which at least some portion of the toddler's legs and feet pass during use, an upper annular surface to which the bottom end region of the supports 24 are attached, the outer cylindrical, circumferential surface in which the track 34 is formed, and a lower annular surface facing the substrate on which the walker 10 rests. Bases 20, 36 may be considered like rings in that they are annular and circular, and define a groove, channel or track with the track 34, 38 in each base 20, 36, respectively, aligning with and cooperating with the track 34, 38 of the other base 20, 36 to define a channel with a substantially circular cross-sectional shape to accommodate the round balls or bearings 40 and allow them to freely rotate.

One way to view this combination of the aligning tracks 34, 38 is like that of a "lazy susan". For the walker 10 to rotate while the substrate support 14 stays in a stationary location, the substrate support 14 would have to function substantially like that of a "lazy susan" wherein one stationary part remains in position while another (rotatable) part rotates relative to the stationary part. Applied to the invention, the substrate support 14 may remain in position while the toddler in the toddler retainer 12 rotates into any direction they want, and can do 360 degree turns and 180 degree U-turns.

The base 36 of the substrate support 14 has an inner cylindrical, circumferential surface in which the track 38 is formed, an upper annular surface which may or may not be contiguous with the upper surface of the base 20, an outer cylindrical surface 44 (see FIG. 1), and a lower annular surface facing the substrate on which the walker 10 rests.

Bearings 40 are considered relative rotation means that allow rotation of the toddler retainer 12 relative to the substrate support 14. These relative rotation means may take any number of different forms other than the bearings 40 in the illustrated embodiment and all such forms known to those skilled in the art of relative rotation systems and bearings are intended to be encompassed by the recitation of relative rotation means.

For example, an alternative relative rotation means may include cooperating structure of two parts with one part being attached to or formed in or integral with the toddler retainer 12 and the other part being attached to or formed in or integral with the substrate support 14. A lubricant may be interposed between the two parts allowing for easy movement of one part relative to the other. Thus, as used herein, the baby walker 10 includes relative rotation means arranged on, in or in connection with the toddler retainer 12 and/or the substrate support 14 and that enable rotation of the toddler retainer 12 relative to the substrate support 14.

It is pointed out that instead of having the base 20 of the toddler retainer 12 inward of the base 36 of the substrate support 14, it may alternatively be outward of the substrate support 14. In this case, the outer circumferential surface of the substrate support is provided with a track while the inner circumferential surface of the toddler retainer 12 is provided with an aligning track and one or more bearings placed into the aligning tracks. The effect is the same as the reverse embodiment, i.e., the toddler retainer 12 rotates relative to the substrate support 14. It is also conceivable to position the base 20 of the toddler retainer 12 above the base 36 of the substrate support 14, in which case, the upper annular surface of the substrate support 14 is provided with a track while the lower annular surface of the toddler retainer 12 is provided with an aligning track and one or more bearings placed into the aligning tracks.

In addition to the base 36, the substrate support 14 includes caster assemblies 46 connected to the base 36, e.g., to the outer (or underside) cylindrical surface 44 thereof as shown in FIGS. 3 and 4. Each caster assembly 46 includes a wheel 48 that enables movement of the walker 10 on the substrate. Rotating balls can be used instead of wheels 48. To support the caster assemblies 46, flanges 50 are connected to or formed integral with a circular portion of the base 36 (see FIG. 3). Attachment of the caster assemblies 46 to the flanges 50 may be by any manner known to those skilled in the art to which this invention pertains.

In the illustrated embodiment, there are four caster assemblies 46 distributed around the circumference of the substrate support 14 (see FIG. 2). However, the number of caster assemblies 46 may vary from four, e.g., three, five, six etc., depending on the characteristics of the baby walker 10, e.g., its size, the expected weight of the toddler using the baby walker 10, and/or the manufacturer's desire. Additionally, the caster assemblies 46 represent any type of movement permitting means that permit movement of the substrate portion 14 along the substrate on which it is placed, e.g., a floor, ground. Instead of caster assemblies 46, any such type of movement permitting means may be used, whether including one or more wheels, balls, and the like. It is also possible to use a single assembly that provides support and allows for movement.

Armature 16 preferably is configured to have an adjustable length which may be achieved in a variety of different ways. Specifically, the elongate armature 16 is adjustable with respect to its length or degree of extension between a point at which it is attached to the substrate support 14 and the object 18 to which it is fixed. An exemplifying armature 16 is preferably a telescoping rod which is comprised of two or more sections (a plurality of sections) that expand and retract relative to one another. A locking mechanism is also provided to enable each section to be movable relative to one or both of its adjacent sections or be locked with respect to movement relative to one or both of its adjacent sections. This locking feature enables the degree or amount of extension (range or total possible length) of the armature 16 to be limited as desired.

In one embodiment, a fluid adjustable telescoping armature (telescoping rod) is mounted to a re-positionable rotational pivotable point on the floor (defined by a stand 86, see FIGS. 1 and 5) or to a wall 82 (see FIG. 8). This allows the toddler in the baby walker 10 to move in any direction that a conventional walker can without risk of injury (falling down stairs, falling into a pool, being burnt by a hot stove), provided the length of the telescoping armature 16 is correctly determined to limit movement of the walker 10 to avoid these situations.

In the illustrated embodiment, the armature 16 is a telescoping armature that has a plurality of sections, namely, three sections 54, 56, 58, with the cross-sectional size of section 58 being smaller than the cross-sectional size of section 56 and the cross-sectional size of section 56 being smaller than the cross-sectional size of section 54. As such, section 58 slides at least partly into an interior of section 56 and section 56 slides at least partly into an interior of section 54. Each section 54, 56, 58 may have the same length, or different lengths can be provided.

Figure 5:
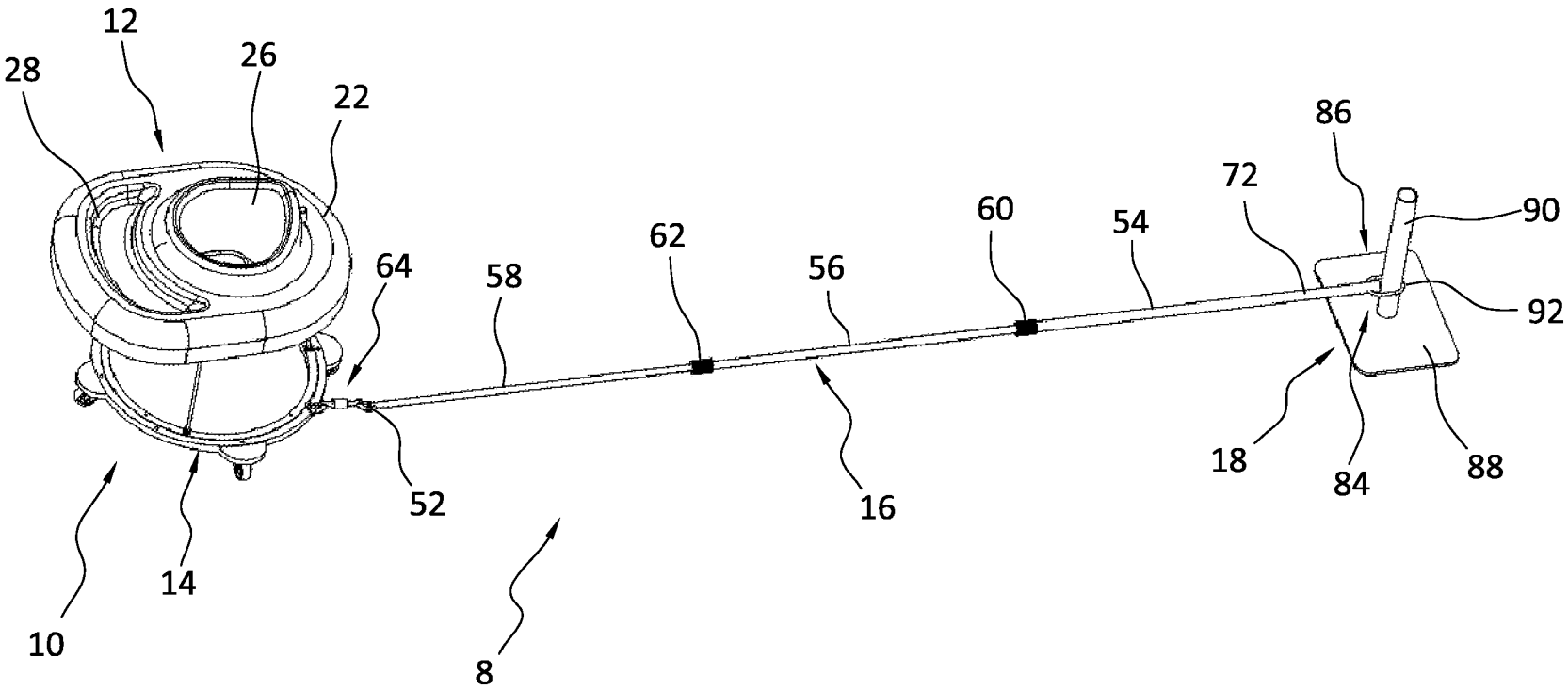
FIG. 5 is another front perspective view of the embodiment shown in FIG. 1 showing the telescoping armature fully extended.

FIG. 1 shows a state wherein section 56 is pushed into section 54 to a maximum extent and section 58 is pushed partly into section 56. FIG. 5 shows a state wherein section 56 is fully extend from section 54 and section 58 is fully extended from section 56.

A locking mechanism 60, 62 is provided at the end of sections 54 and 56, respectively. The locking mechanism 60 is designed to lock section 56 relative to section 54. The locking mechanism 62 is designed to lock section 58 relative to section 56. Such locking mechanisms for a telescoping armature are known to those skilled in the art to which this invention pertains.

With three sections 54, 56, 58, armature 16 can be used at numerous variable lengths. For example, armature 16 has a maximum length when section 58 is fully extended from section 56 and section 56 is fully extended from section 54 (see FIG. 5). If the environment of use of the system 8 is sufficient to allow the toddler this maximum length from a stationary object 18 to which the other end region of the armature 16 is fixed, the toddler can move inside of a circle having the radius of the length of the armature 16 (plus the extension of the walker 10). Locking mechanism 60, 62 do not have to be, and preferably are not, locked so that the armature 16 can telescope inward and outward (operatively changing the length of the armature 16) depending on the movement of the toddler in the walker 10.

If the environment of use of the system 8 is only sufficient to allow the toddler to move inside of a circle having the radius of the section 54, then section 58 is pushed into section 56 and locking mechanism 62 actuated to lock sections 56 and 58 together and section 56 is pushed into section 54 and locking mechanism 60 actuated to lock sections 54 and 56 together. With this state, the toddler can move the walker 10 only inside the circle having a radius which is about the length of section 54 (plus the extension of the walker 10).

If the environment of use of the system 8 is only sufficient to allow the toddler to move inside of a circle having the radius which is the combined length of two sections (assuming the sections 54, 56, 58 have a substantially common length), then section 58 is pushed into section 56 and locking mechanism 62 actuated to lock sections 56 and 58 together. Locking mechanism 60 does not have to be, and preferably is not, locked so that the armature 16 can telescope inward and outward (operatively changing the length of the armature 16) depending on the movement of the toddler in the walker 10, i.e., section 56 can telescope inward into section 54 and outward from section 54. Alternatively, section 56 is pushed into section 54 and locking mechanism 60 actuated to lock sections 54 and 56 together. Locking mechanism 62 does not have to be, and preferably is not, locked so that the armature 16 can telescope inward and outward (operatively changing the length of the armature 16) depending on the movement of the toddler in the walker 10, i.e., section 58 can telescope inward into section 56 and outward from section 56 (FIG. 1 showing an intermediate position of section 58 in section 56).

In either of these states, the toddler can move the walker 10 only inside the circle having a radius which is about the length of two sections, either sections 54 and 56 in the first instance or sections 56 and 58 in the second instance (plus the extension of the walker 10).

It is also possible to partly extend section 58 from section 56 and/or partly extend section 56 from section 54 and then actuate locking mechanism 60 and 62, respectively, to effectively provide for multiple, variable lengths for the armature 16. Moreover, by providing more than three sections in armature 16, it is possible to greatly increase the length of the armature 16 or the number of different lengths of the armature 16 between the maximum and minimum lengths.

Although armature 16 is described as being adjustable in length via a telescoping effect, other structure that provides an adjustment in the length of an elongate member may be used in the invention. Armature 16 might also be a rigid, fixed length component, but this is not a preferred embodiment.

System 8 also includes a coupling or attachment mechanism 64 at one end region 52 of the armature 16 that couples the armature 16 to the substrate support 14 while allowing swiveling of the substrate support 14 relative to the armature 16. Specifically, the attachment mechanism 64 connects the armature 16 to the base 36 of the substrate support 14. Attachment mechanism 64 is configured to enable the substrate support 14 to swivel about the end region 52 of the armature 16. As used herein, attachment means for attaching one end region of the armature 16 to the substrate support 14 encompasses any structure formed on or part of one or both of the substrate support 14 and armature 16 that allows for swiveling of the substrate support 14 relative to the end region 52 of the armature 16.

Figure 6:
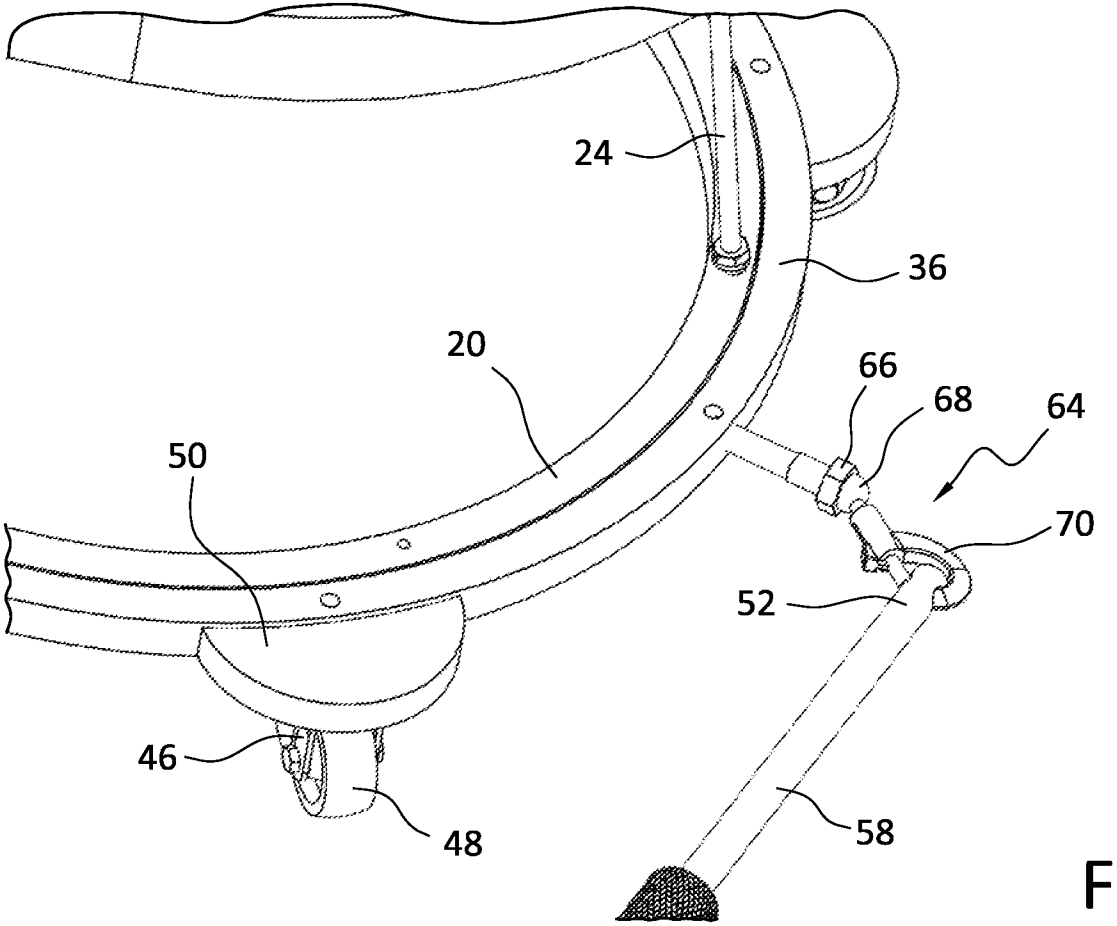
FIG. 6 is an enlarged view of the attachment of the armature to the substrate support of the embodiment shown in FIG. 1.

A first embodiment of the attachment mechanism 64 is shown in FIGS. 1 and 2, and more clearly in FIG. 6, and comprises a ball and socket joint with the socket portion 66 being attached to the substrate support 14 and the ball portion 68 being attached to the end of the armature 16. The socket portion 66 may be attached using a support secured to or formed integral with the base 36 of the substrate support 14, and which projects radially outward from the outer circumferential surface of the base 36.

Ball portion 68 also includes a clasp 70 to which the end of the armature 16 is attached (see FIGS. 1 and 6). To facilitate this attachment, the end region 52 of the armature 16 is provided with an aperture through which the clasp 70 passes (FIG. 6). Ball portion 68 is freely rotatable in socket portion 66 as known to those skilled in the art of ball and socket joints.

Figure 7:
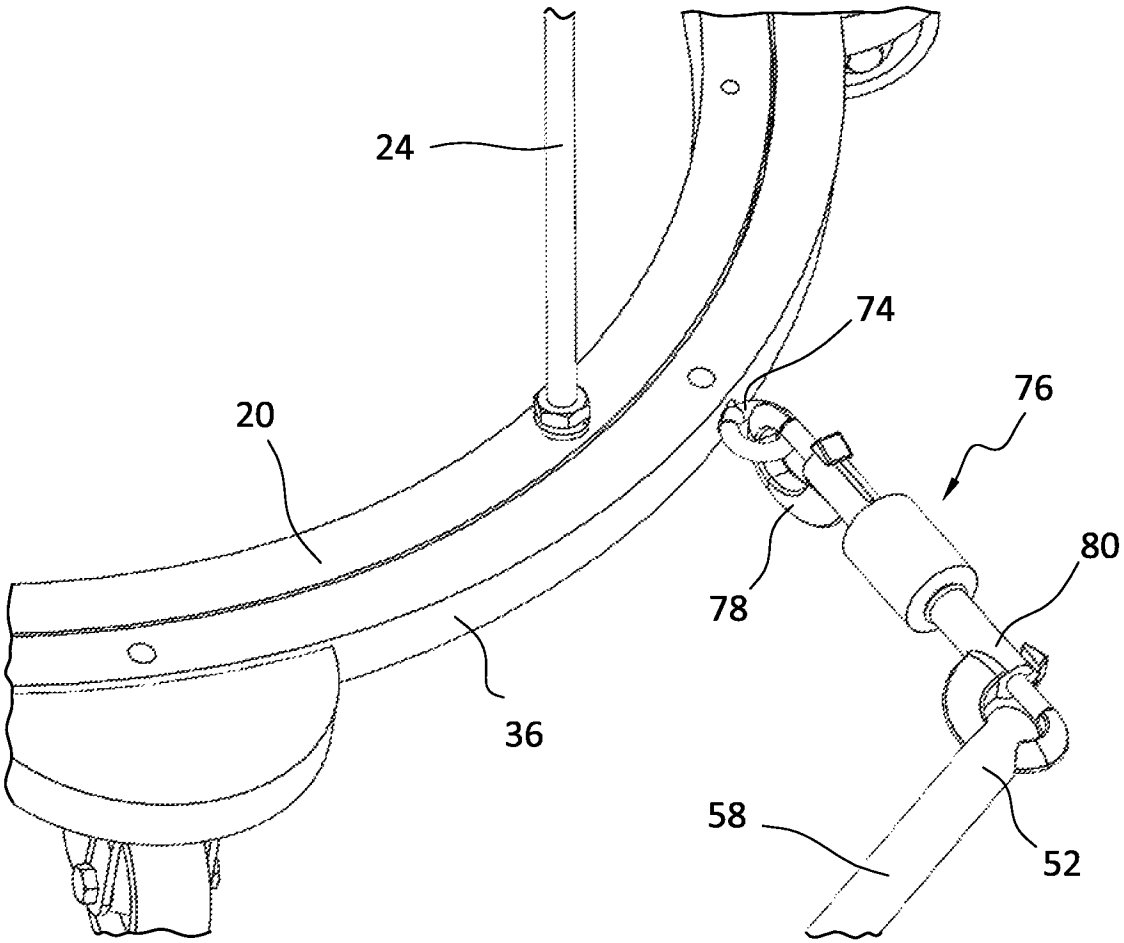
FIG. 7 is an enlarged view of an alternative attachment of the armature to the substrate support of the embodiment shown in FIG. 1.

A second embodiment of the attachment mechanism is shown in FIG. 7 and comprises a hoop and clasp assembly including a loop or hoop 74 attached to the base 36 of the substrate support 14 and a clasp component 76 having a first clasp 78 extending through the hoop 74 and a second clasp 80 extending through the aperture in the end region 52 of the armature 16. As shown in FIG. 7, the hoop 74 extends from the outer circumferential surface of the base 36. As an alternative, the hoop 74 may be formed with a threaded portion which is passed through a vertical aperture in the base 36 from the upper annular surface to the lower annular surface, and then secured to the base 36 by a bolt tightened against the lower surface from the bottom.

In both embodiments in FIGS. 6 and 7, it is preferable that the connections be to that of the edge of the base 36 which provides the most free movement for the invention. If the attachment point were on the top side of the base 36, the 360 degree turn may not be possible insofar as it could be obstructed by engaging, for example, one of the supports 24. FIG. 6 shows where the socket portion 66 protrudes or extends longer than the flanges 50, note though that in some embodiments, there may be wheels under the base 36 (without flanges 50) and as such, the attachment to the edge of the base 36 provides optimal turning and movement of the walker 10.

System 8 also includes an attachment mechanism 84 at an opposite end region of the armature 16, to that end region 72 at which the armature 16 is connected to the substrate support 14, and which attachment mechanism 84 couples the armature 16 to the fixed or otherwise stationary object 18 while allowing swiveling of the armature 16 relative to the stationary object 18. As used herein, attachment means for attaching one end region of the armature 16 to the stationary object 18 encompasses any structure formed on or part of one or both of the armature 16 and fixed object that allows for swiveling of the end region of the armature 16 relative to the fixed object.

Referring back to FIG. 1, FIG. 1 shows a stand 86 as an example of a stationary object 18 to which the end region 72 of the armature 16 is attached. Stand 86 is designed to be stationary and to this end, includes a weighted or secured base 88 and a pole 90 extending upward from the base 88. The armature 16 is attached to the pole 90 in a manner to enable the armature to swivel about the pole 90. For example, the end region 72 of the armature 16 may be provided with a ring or loop 92 which is placed over the top of the pole 90 and urged downward along the pole 90, e.g., to the position shown in FIG. 1. The open interior of the loop 92 is slightly larger than the cross-sectional shape of the pole 90 and therefore allows the loop 92 to turn about the pole 90 and thus the armature 16 to swivel about the stand 86.

Figure 19:
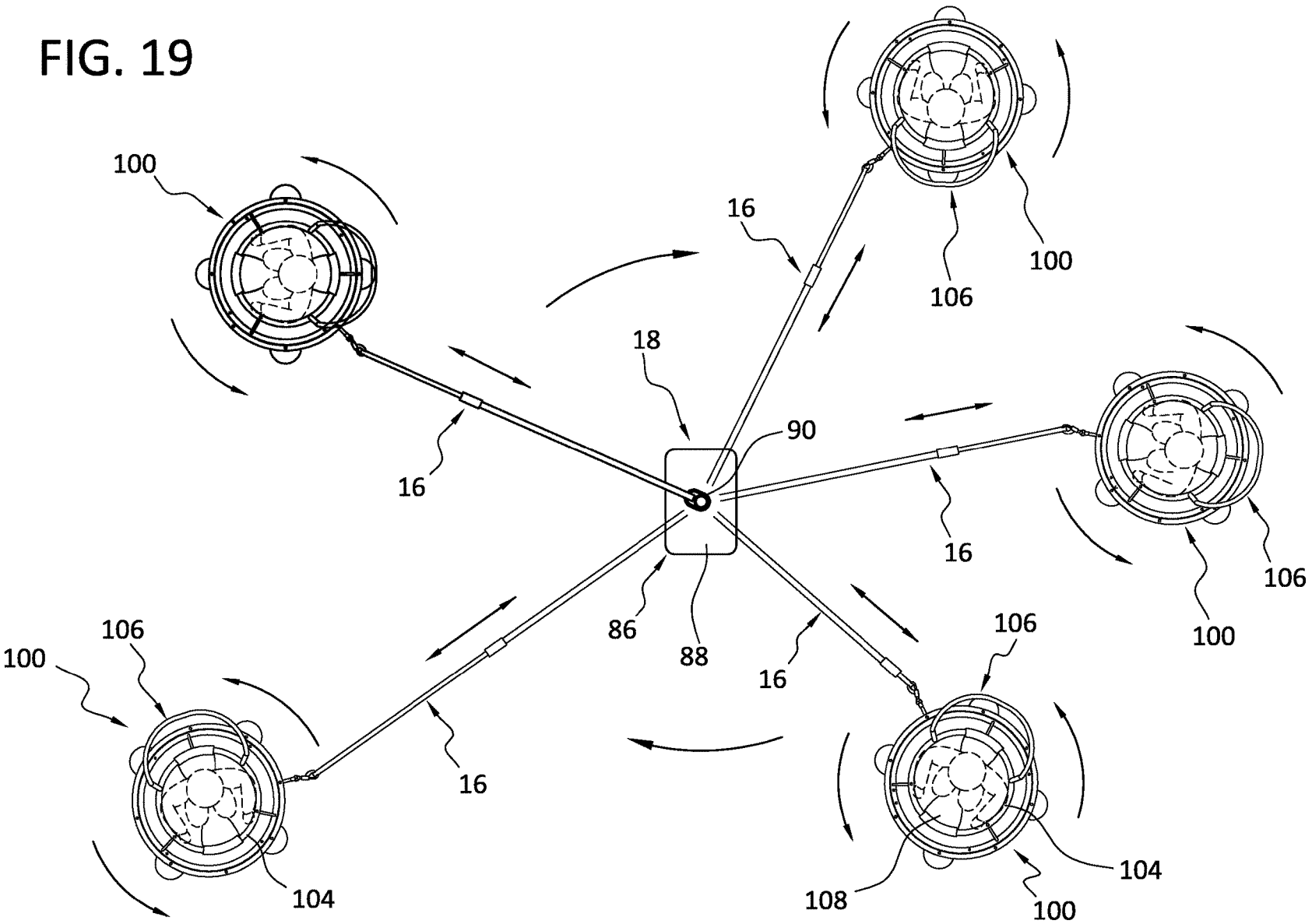
FIG. 19 is a view showing possible movement of the walkers in the learn-to-walk system of FIGS. 11 and 15.

As shown in FIGS. 1 and 5, the armature 16 is fixed to the stand 86 which serves as a center post or the point about which the walker 10 rotates (see FIG. 19). The stand 86 serves as a fixed point that can be placed in a central area of a floor to maximize the space in which the walker 10 can be moved by the toddler. By placing the stand 86 in a central area of a floor, it is possible for the toddler to move the walker 10 over a broad range of length variations and combinations in a 360 degree area yet be restricted by the length of the armature 16. The length of the armature 16 imposes a maximum length of movement of the walker 10 about the stand 86. As mentioned above, the parent, caregiver or person monitoring the toddler can determine the limits of the movement of the walker 10 by adjusting the length of the armature 16 relative to the area in which the system 8 is placed.

A high friction rubberized pad may be placed on the lower surface of the base 88. Such a pad is designed not to slide when pulled and can anchor the stand 86 in a stationary position.

Instead of the stand 86, other mechanisms to fix the end of the armature 16 can be provided, whether as a center post or which provide less than 360 degrees of available movement. Such mechanisms will be referring to as fixing means for fixing an end of the armature 16 relative to a stationary object while allowing pivotal movement of the armature 16 relative to that object. The range of pivotal movement depends on the structure of the fixing means. For the stand 86 used as the fixing means, the range of pivotal movement is 360 degrees since the armature 16 can swivel 360 degrees about the stand 86.

Other fixing means include a power suction cup (or, for example, a fastened bracket which may be screwed or adhered with hook and loop fasteners (e.g., of the VELCRO™ type) or double-sided tape) that may be attached to the end region 72 of the armature 16 and then pressed against a surface. If the suction cup is oriented downward, the suction cup would be pressed against the floor and include a pole like the stand 86 and about which the loop 92 at the end region 72 of the armature 16 is placed.

Another fixing means is a ball joint fixture in which either the ball portion of this fixture or the joint portion of this fixture is attached to a stationary object, e.g., the base 88 or a wall, and the other portion is attached to the end region 72 of the armature 16. Attachment of the ball joint fixture to the base 88 provides 360 degrees of rotation. Coupled with the adjustable length, telescoping armature 16, the system 8 would conceivably allow 360 degrees of rotation and extended distance limits for the walker 10. Attachment of the ball joint fixture to a wall provides about 180 degrees of rotation, and thus is not as favorable as use of a stand 86, but due to available space, stand 86 may not be practical. A mounting element for attaching the ball portion or joint portion to a wall can be designed and within the purview of one skilled in the art to which this invention pertains.

Yet another fixing means is shown in FIG. 8 wherein a portion of a wall 82 is shown and the fixing means comprise a loop 94 attached to the end region 72 of the armature 16. A bracket 96 is attached to the wall 82 and configured to accommodate the loop 94. For example, the bracket 96 may be formed like a carabineer with a section that can be manually pressed inward to open the interior of the bracket 96 and allow the loop 94 to be inserted, with the section then being allowed to return to a closed state. The loop 94 is securely retainer and allowed to swivel about the bracket 96. This type of fixing means provides about 180 degrees of variable movement and rotation, with the movement of the walker 10 being limited in this angular span by the length of the armature 16. As an alternative, the wall may be provided with the loop and the carabineer-type bracket provided on the end region 72 of the armature 16.

The bracket 96 may be attached to the wall 82 in a position (at a height) to render the armature 16 in a horizontal plane. The bracket 96 could thus be situated the same distance above the surface on which the walker 10 is located as the point of attachment of the armature 16 to the walker 10.

A kit may be sold with the system 8 to enable attachment of the armature 16 to the wall 82. This kit would include the wall-mountable bracket 96 with appropriate installation hardware, e.g., screws, to enable the bracket 96 to be secured to a wall, or any other structure, e.g., a floor, dresser.

Still another fixing means comprises a high tack double-sided synthetic sheet on a substantially smooth (non-carpeted) floor whereby this reusable substrate significantly resists sliding and stays substantially in place. A preferably round post with a flat base (like pole 90) is then pressed onto this tack surface encouraging the post to remain stable, straight up and solidly in place (like stand 86). A ring-like loop 92 is attached to the end of the telescope adjustable armature 16 thus allowing the ring to rotate freely 360 degrees around the round post. With armature 16 attached at its other end to the substrate support 14 of the walker 10, it is therefore now possible for the toddler in the walker 10 to freely travel up to 360 degrees within the length limits of the telescoping armature 16. By contrast, with the armature 16 attached to a flat wall, the range of movement is only about 180 degrees.

In an embodiment wherein the mounting bracket 96 on the wall is placed on a 90 degree right angle protruding corner of a room, there would be about 270 degrees of variable movements limited from the minimum to the maximum length of the telescoping armature 16. Nevertheless, the maximum range of movement of the walker 10 would be when the armature 16 is fully rotational around a central member that allows the full range of movement limited by the minimum and maximum lengths of the telescoping armature 16.

With the foregoing structure, several novelties are attained. First, when the armature 16 retains the substrate support 14 in a stationary, fixed position, the toddler retainer 12 can turn in any direction since it rotates relative to the substrate support 14. A toddler can turn to any angular orientation, around and around if so desired, all while the substrate support 14 does not move.

Second, the toddler can move within limits imposed by the length of the armature 16. If the armature 16 has a length of 12 feet and is mounted to the stand 86, the toddler is able to move in a circle about the stand 86, this circle having a radius of a little more than 12 feet. As such, if there is a staircase 15 feet from the stand 86, the toddler is not able to reach the staircase and any possible injury from falling down the staircase is entirely eliminated.

Third, since the armature 16 is adjustable, if the staircase is 12 feet from the stand 86, then the armature 16 can be adjusted to have a length of, e.g., 9 feet, in which case, the toddler is able to move in a circle about the stand 86, this circle having a radius of about 9 feet (and definitely less than 12 feet), and cannot reach the staircase. The ability of the toddler to roll along the substrate is therefore limited relative to conventional walkers in which they are virtually no limits to movement of the walkers.

When placed in the walker 10 of the system 8, the toddler is limited to a defined area where they can move freely in any direction and in any angle. They can move in reasonably all directions and can turn effectively to move in a reasonably number of directions and angles limited by the length of the allowed telescope limits. In combination with 360 degree inner turns of the toddler retainer 12, the four or more rolling omni-directional caster assemblies 46 and a expanding/contracting telescoping armature 16 linked to the walker 16 at one end region 52 and attached with pivotable movement on a defined, secure opposite end region 72 allows a vast combination of angular and straight combinations and permutations to occur. Relative movement variations to the fixed pivot point defined by the object 18 are near exhaustible within a pre-determined set of limits.

Most importantly, these limits are adjustable each time before every use of the walker 10 to be within a limited range defined as a "safety barrier" for that specific use and that does not exceed the range to cause potential harm to the toddler learning to walk. Walker 10, which allows the toddler to literally turn on a dime, is also superior to existing walkers requiring wider radius turns which require more floor real estate.

This rotational capability, as it relates to the invention, differentiates itself from most if not all conventional walkers insofar as the toddler can, if so desired, move the walker 10 straight in one direction along a defined path, then stop, turn around (a 180 degree turn) while the caster assemblies 46 remain substantially in the same spot, and walk right back to the exact starting point along the exact path. While this may not be so critical or important when the walker 10 is operating without the attached telescoping armature 16, it becomes important when the walker 10 is used in conjunction with the attached variable-length smooth fluid (preferably) operating adjustable telescope armature 16 (as the system 8). In this regard, although not preferred, the walker 10 can be used without the armature 16.

Indeed, the armature 16 might also be a rigid, fixed length component, but in a preferred embodiment, the armature 16 provides a telescopic link between a stationary object 18 and the substrate support 14 and enables variability in the distance between the walker 10 and the stationary object 18 within a minimum and extended range of operation. Nonetheless, the walker 10 used without the adjustable-length armature 16 is still believed to be novel over most if not all conventional walkers. For example, one aspect of novelty is configuration and construction of the walker 10 to make a complete turn (360 degrees) while the caster assemblies 46 remain in stationary positions. This has an advantage insofar as the toddler can negotiate the walker 10 to make a full turn without needing to make a substantially wide radius turn, which is particularly useful in smaller space and offers the toddler a learning experience in "turning on the dime" to coin a phrase. Such a dexterous learning experience offers a more real world experience as opposed to making a wide turn as are required in the myriad of conventional walkers on the market. For the sake of comparison, when an adult wants to turn around, they pivot and do not make a wide radius turn. As such, the system 8, regardless of the type of armature 16 coupled to the walker 10, provides an adult-like simulation of responsive turn-around.

The numerous combinations of directional movements enabled by walker 10 in accordance with the invention are limited by, for example, the configuration of the telescoping of the armature 16 (i.e., the expansion and retracting movements of the sections thereof relative to one another). The essentially zero turning radius (the toddler retainer 12 can turn 260 degrees without movement of the substrate support 14 as discussed above), and the wider turning radius available if so desired which occurs when the substrate support 14 moves, provide considerable freedom for the toddler in the walker 10 to freely move in an omni-directional manner, but only in movement which is safe insofar as it has parent or caregiver-determined safety barriers.

Another advantage is that the telescoping armature 16 functions like a piston, and contracts and expands in length based on the toddler's movement and the adjustable limits set by the parent or caregiver. As the toddler moves away from the pivot point (e.g., defined by stand 86 or other object 18), the telescoping sections 54, 56, 58 of the armature 16 extend in length as they are dragged further open by the travel of the walker 10 (assuming none of the locking mechanisms 60, 62 are actuated). Conversely, as the walker 10 moves closer to the pivot point, the telescoping armature 16 retracts upon itself and its length is reduced.

The ability of the toddler to make a full turn without a wide stance required by a significant number of conventional walkers, allows the walker 10 to go forward, back, left, right and any combination thereof without obstacles or restriction.

Placement of the telescoping armature 16 on a conventional walker does not provide the same advantages as use of the telescoping armature 16 connected to the walker 10 disclosed herein wherein the relative rotation means are provided to enable rotation of the toddler retainer 12 relative to the substrate support 14. A telescoping rod on the side of a conventional baby walker does not enable the toddler to make a U-turn, and moreover restricts variable movement of the walker. For example, the toddler may walk in one direction, but cannot easily turn to walk back in the original direction, the toddler will get caught trying to turn around to face the original direction. As such, the toddler must back up to face the original direction. By contrast, walker 10 solves this problem by making a U-turn independent of the caster assembles 46 (obtained by the relative rotation means) and enables the toddler to easily turn and face the original direction. Nevertheless, as discussed herein in particular with respect to FIGS. 23 and 24, the telescoping armature 16 can be used with a conventional walker, optionally along with the stationary object 18, e.g. stand 86.

Furthermore, depending on the extended length of the telescoping armature 16, as well as the number of sections 54, 56, 58, the baby walker with 360 degrees of rotation coupled to the sections offers a large number angles and directions to the toddler for movement while remaining within safety limits pre-set by the parent or caregiver. So, for example, if the system 8 is used on the $2^{nd}$ floor near a staircase, the second end region 72 of the armature 16 can be anchored, e.g., to the stand 86 or wall 82, and the other end coupled to the substrate support 14, with the stand 86 being appropriately placed and/or the armature 16 being appropriately sized relative to the wall 82 so that the maximum extension of the armature 16 does not pose the possibilities of danger and subsequent injury to the toddler. The toddler is able to learn to walk without fear of injury in the approximately four second unobserved window that in the past sent toddlers to the emergency room. The invention instills confidence in parents and caregivers that they can establish limit guidelines for movement of the walker 10 that ensure safety of their toddler.

A retrofit of existing walkers is also considered to be part of the invention. For a retrofit, a conventional walker having a unitary toddler retainer and substrate support is modified to include the armature 16, this combination of a conventional walker and armature 16 being considered a learn-to-walk system in accordance with the invention, also optionally with the stationary object 18, such as the stand 86. In such conventional walkers, as mentioned above, the toddler retainer does not rotate freely relative to the substrate support. Rather, they are an integral unit. Nevertheless, by providing armature 16 that telescopes to provide variable lengths, advantages can still be obtained, e.g., imposing movement limitations on the walker. Thus, reciting individually a toddler retainer and a substrate support, as in the claims, does not imply that these are separate and distinct components but rather, as in a conventional walker, they may be different parts of a common, integrated unit, one part constituting the structure that retains the toddler and the other part constituting the structure that supports the unit on a substrate.

In a retrofit embodiment, one end region of the armature 16 is attached or otherwise coupled to the substrate support (portion) of the conventional walker in a manner that could allow the substrate support to swivel relative to that end region. This may be accomplished using existing structure on the conventional walker and without any additional attachment or coupling structure, or using an additional attachment or coupling structure, As to the former embodiment wherein existing structure of the conventional walker is attached to the armature 16, in one embodiment, it is possible to attach a clasp 78 of the clasp component 76 at the end region 52 of the armature 16 around an axle or pivot pin 98 connecting a wheel or caster assembly 46 to the substrate support of the walker, or to an upper region of a rotating wheel of the walker (see FIG. 9 which shows such an attachment but with the walker 10 in accordance with the invention instead of an existing walker). This clasp 76 can be opened to allow the axle or pivot pin to be inserted into the interior of the clasp 76 and then the clasp 76 closed. The armature 16 stays coupled to the wheel or caster assembly since the opening of the clasp 76 is sized to be less than the size of the wheel or caster assembly. The presence of the clasp 76 does not affect wheel rotation.

Figure 9:
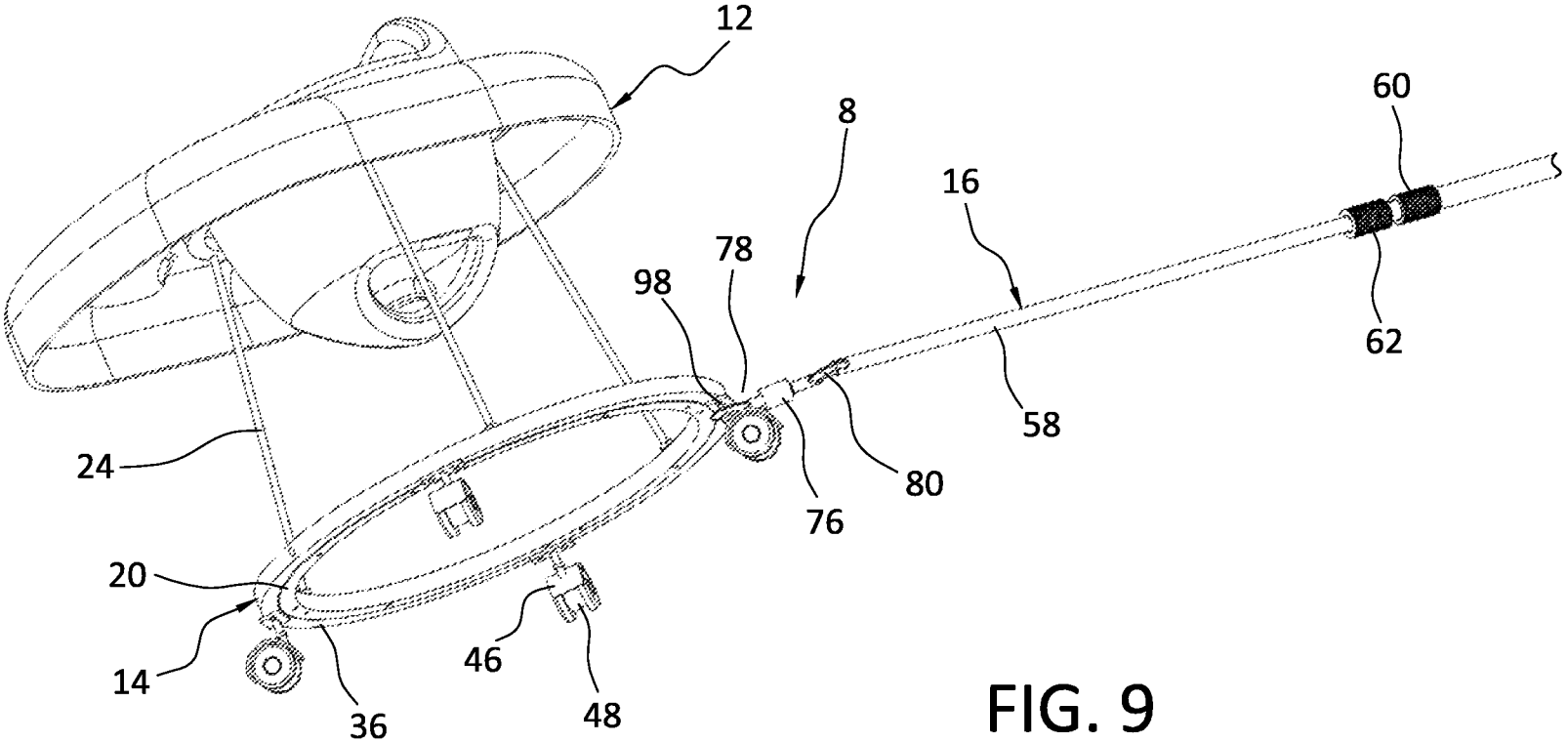
FIG. 9 is a front perspective view of a second embodiment of a learn-to-walk system wherein the armature is attached to a wheel assembly.
Figure 10:
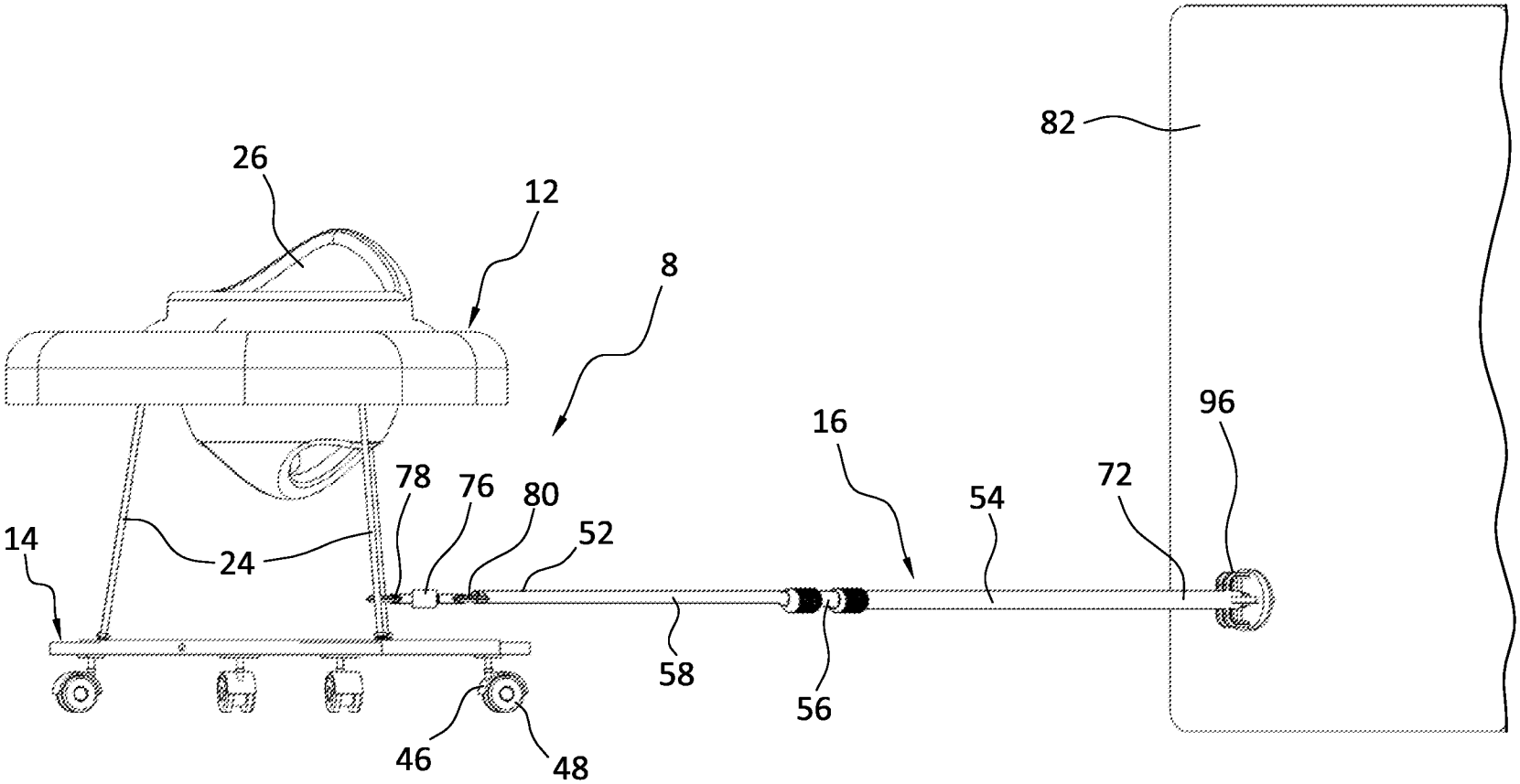
FIG. 10 is a front perspective view of a third embodiment of a learn-to-walk system wherein the armature is attached to a support.

The armature 16 could also be configured to quick-connect to a part of the existing baby walker, whether to the wheel or caster assembly like depicted in FIG. 9 or to the support of the existing walker as depicted in FIG. 10 wherein the clasp 78 of the clasp component 76 is attached to the support 24 of the walker 10 (but which support is commonly also present on existing walkers). Indeed, depending on the design and construction of the existing baby walker, the armature 16 can be attached to many locations, e.g., if the armature 16 is provided with a carbineer type connector, it can be easily attached to any bar or rod on the walker, whether of the toddler retainer portion of the walker or the substrate support portion of the walker. Many existing baby walkers have bars.

Regardless of the point of attachment of the armature 16 to the existing baby walker, by linking the rotational wheel of the existing baby walker, safety limits to the movement of the existing baby walker can be imposed by the parent or caregiver as discussed above via setting of the armature 16 and positioning of object 18 to which the armature 16 is attached. Also, although the attachment mechanism of the armature 16 to the existing walker is referenced in FIGS. 9 and 10 as being the clasp component 76, other attachment mechanisms may be used. While most, or all, of the existing baby walkers so retrofitted will have less range of movement and turns than system 8 (since walker 10 is not used), this retrofit attachment link from the walker to a flat surface wall, or a fixed mounted wall bracket, or a floor-mounted object whereby the unit revolves around a pole, would limit the range and provide the parent and caregiver with safety limits and thus reduce serious accidents.

As such, although a retrofit of a conventional walker is obviously not as advantageous as walker 10 in that there is no relative rotation between the toddler retainer and the substrate support; nevertheless, some advantages are obtained by the variable-length armature 16 serving to limit movement of the walker.

Additional possibilities for using conventional walkers and innovative components disclosed herein to provide advantageous modifications to conventional walkers are discussed below with reference to FIGS. 23 and 24.

Referring now to FIGS. 11-22, another embodiment of a system in accordance with the invention is designed for use with what are commonly referred to as a "Baby Walking Wings". These walking wings generally include a harness that supports the toddler while simultaneously the parent or caregiver holds the toddler up as the toddler learns to walk. There is thus a need for the parent or caregiver to lead or follow the toddler while the parent or caregiver is holding on to a connected handle(s), thereby restricting fluid movement of the toddler in the walking wings.

The inventor has realized that it is desirable to eliminate the need for the parent or caregiver to hold up the harness as the toddler walks in the walking wings. By incorporating a handle retainer into a walker, the toddler can operate in a similar manner like use of walker 10 without parental direction.

To this end, a second embodiment of a system in accordance with the invention is a modification of the system 8, primarily a modification of the walker 10, and only different elements will be assigned new reference numbers. This embodiment of the walker is designated generally as 100 and may typically be used for more advanced toddlers in the walking process and so there is no need for the platform 22 with a tray area 28 as in walker 10 described above. Walker 100 may be used with armature 16 as described above in any of its various configurations, or alone without armature 16.

Walker 100 includes a toddler retainer 102 for retaining or supporting the toddler, and the substrate support 14 for supporting the toddler retainer 102 while allowing rotation of the toddler retainer 102 relative to the substrate support 14. The armature 16 of the system 8 is mounted at one end region to the substrate support 14 and can be mounted at an opposite end region to a fixed-in-position or otherwise stationary object 18, e.g., the stand 86 via loop 92 around pole 90 as shown in FIG. 11 or the wall 82 via loop 94 and cooperating mounting bracket 96 as shown in FIG. 12.

Toddler retainer 102 includes the base 20, an upper support rim 104, one or more of the supports 24 that support the upper support rim 104 a distance above the base 20, and a retaining structure 106 attached to or formed integral with the upper support rim 104.

Optionally, an adjustable positioning member 108 is attached at opposite end regions to the upper support rim 104 to support a toddler using walker 100 (described below with reference to FIGS. 21 and 22). Positioning member 108 should be adjustable to enable it to be securely positioned around the toddler's crotch and provide for height adjustment and safety (preventing the child from falling inward). Positioning member 108 is, however, optional, since the toddler is retained by other structure described below when walker 100 is used with conventional walking wings 110 as is its intended purpose. Furthermore, while not shown, it is also possible to provide a wider positioning member 108 with slot openings for placement of the toddlers legs further insuring safety provision. In other words, a wider slot may have two apertures 30 with a middle section 32 therebetween (see FIG. 2) Positioning member 108 may be considered or constitute a netted crotch support or safety net.

Figures 11, 12:
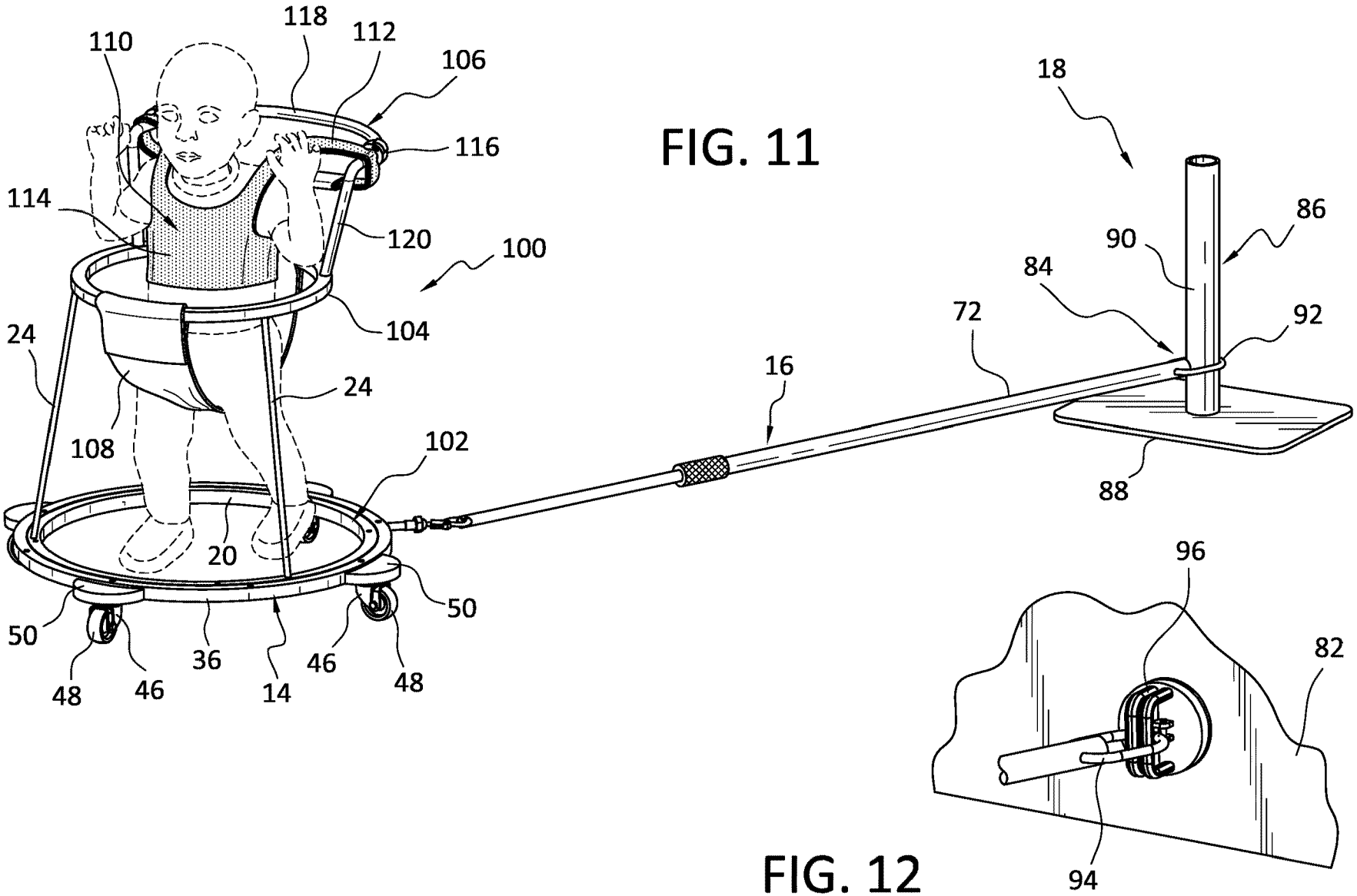
FIG. 11 is a front perspective view of a fourth embodiment of a learn-to-walk system including a baby walker in accordance with the invention.
FIG. 12 is an enlarged view of an alternative attachment of the armature of the learn-to-walk system in accordance with the invention shown in FIG. 11.
Figure 13:
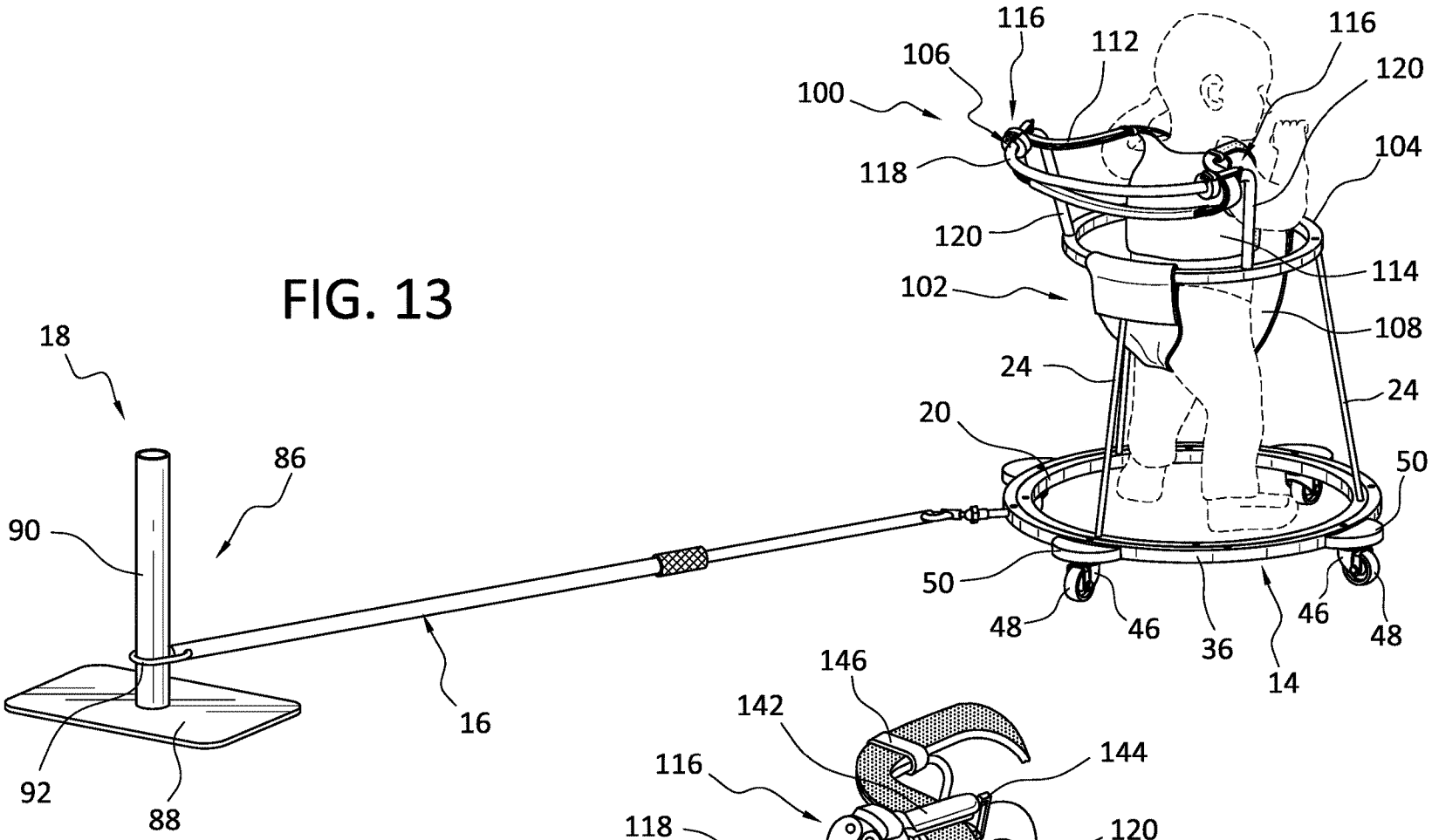
FIG. 13 is a rear perspective view of the first embodiment shown in FIG. 11.

Specifically, the walking wings 110 typically include a harness or handle 112 that is connected to a torso portion 114 placed around the toddler's torso (see FIG. 11). The handle 112 is therefore secured to the retaining structure 106 with little play to thereby secure the toddler via the walking wings 110 to the toddler retainer 102 in a position in which the toddler's feet touch the substrate on which the walker 100 is placed.

Figure 14:
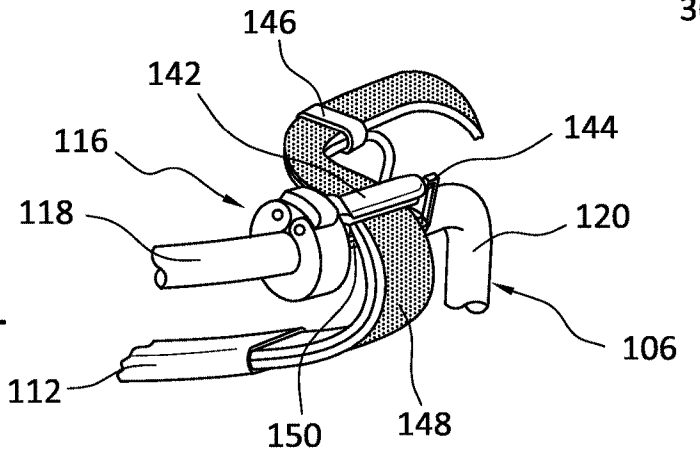
FIG. 14 is an enlarged view of a clamp of the embodiment shown in FIG. 11.
Figure 16:
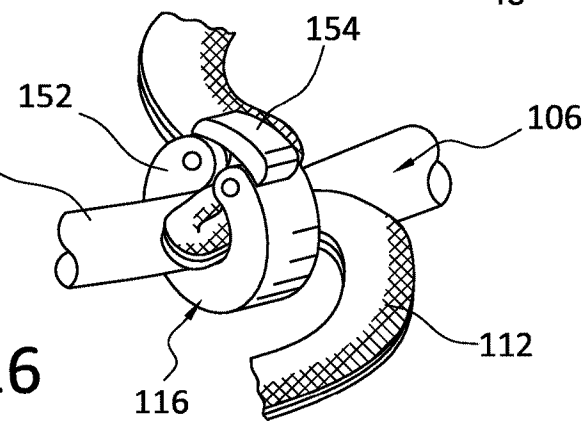
FIG. 16 is an enlarged view of an alternative attachment of the armature of the learn-to-walk system in accordance with the invention shown in FIG. 15.

More specifically, the retaining structure 106 includes a pair of clamps 116 that clamp the handle 112 (best seen in FIGS. 14 and 16). The parent can actuate the clamps 116 to clamp the handle 112 and thereby secure the walking wings 110 to the retaining structure 106. Appropriate positioning of the handle 112 into the clamps 116 provides for the optimum positioning of the walking wings 110 so that the toddler's feet just touch the substrate and do not drag on the substrate (along with adjustment of the height of the retaining structure 106 if adjustable and the placement of the positioning member 108 if provided). Although the illustrated embodiment includes two clamps 116, a single clamp or more than two clamps may be used.

As seen in FIG. 14, the clamp 116 comprises a first part 142 over the handle 112, a cooperating second part 150 below the handle 112 and a release tab 144 at the end of the parts. The clamp parts 142, 150 are sized to engaged with and press the handle 112 therebetween when the release tab 144 is engaged with one or both of the clamp parts. The release tab 144 allows the clamp 116 to spring open when manually actuated and separated from one or both of the clamp part(s) 142, 150 to which it is engaged, i.e., when it is desired to release the handle 112 from its clamping. The release tab 144 also is engaged after the handle 112 is placed between the clamp parts 142, 150 to thereby secure the handle 112 to the clamp 116. Release tab 144 may be biased to the open position or biased to the closed and engaged position. Release tab 144 may be made of plastic and is flexible or resilient.

The sides of the clamp parts 142, 150 that engage with the handle 112 may be provided with a soft rubber coating or similar surface to improve traction and gripping of the handle 112. The length of the clamp parts 142, 150 is set relative to the thickness of common handles on walking wings, e.g., about 2.5 inches. A guide member 146 may also be provided in association with each clamp 116 to guide the handle 112.

In some embodiments, the handle 112 of walking wings may be modified, e.g., by providing a kit with the walker 100 or armature 16, to include rubberized material 148 to apply to the portion of the handle that will be clamped by clamps 116. This would further increase the traction.

Retaining structure 106 comprises an elevated bar portion 118 and support portions 120 that elevate the bar portion 118 above the upper support rim 104 (see FIGS. 11, 13, 15, 17 and 18). The clamps 116 are attached to the bar portion 118, and may be adjustable in position along the length of the bar portion 118. Often, the handle 112 would drape over the bar portion 118 and then be secured by clamps 116. The bar portion 118 and support portions 120 preferably have rounded edges and no sharp corners to avoid injury. Retaining structure 106 may be structured so that the support portions 120 snap into the upper support rim 104

Figure 15:
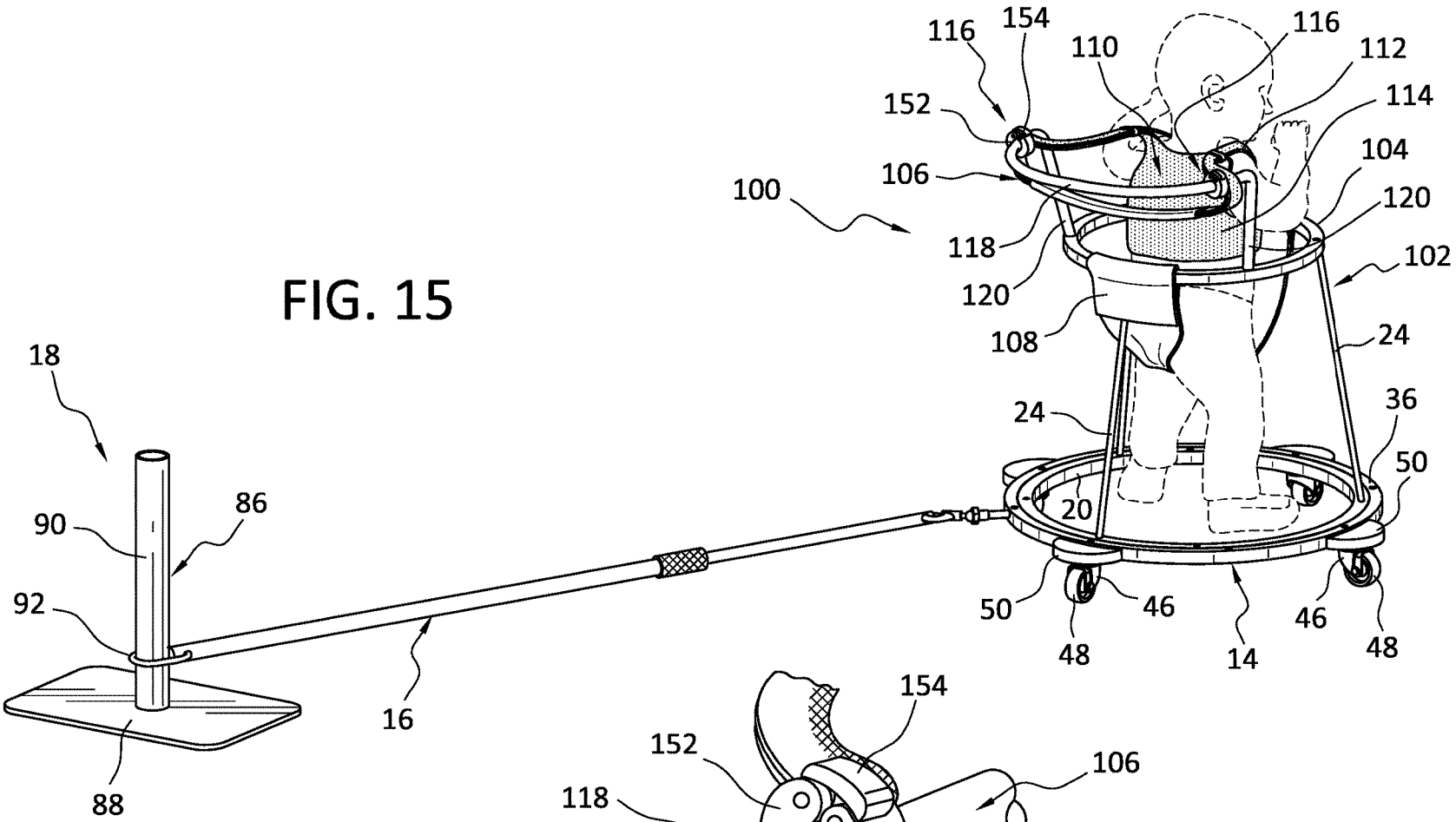
FIG. 15 is a front perspective view of a fifth embodiment of a learn-to-walk system including a baby walker in accordance with the invention.
Figure 17:
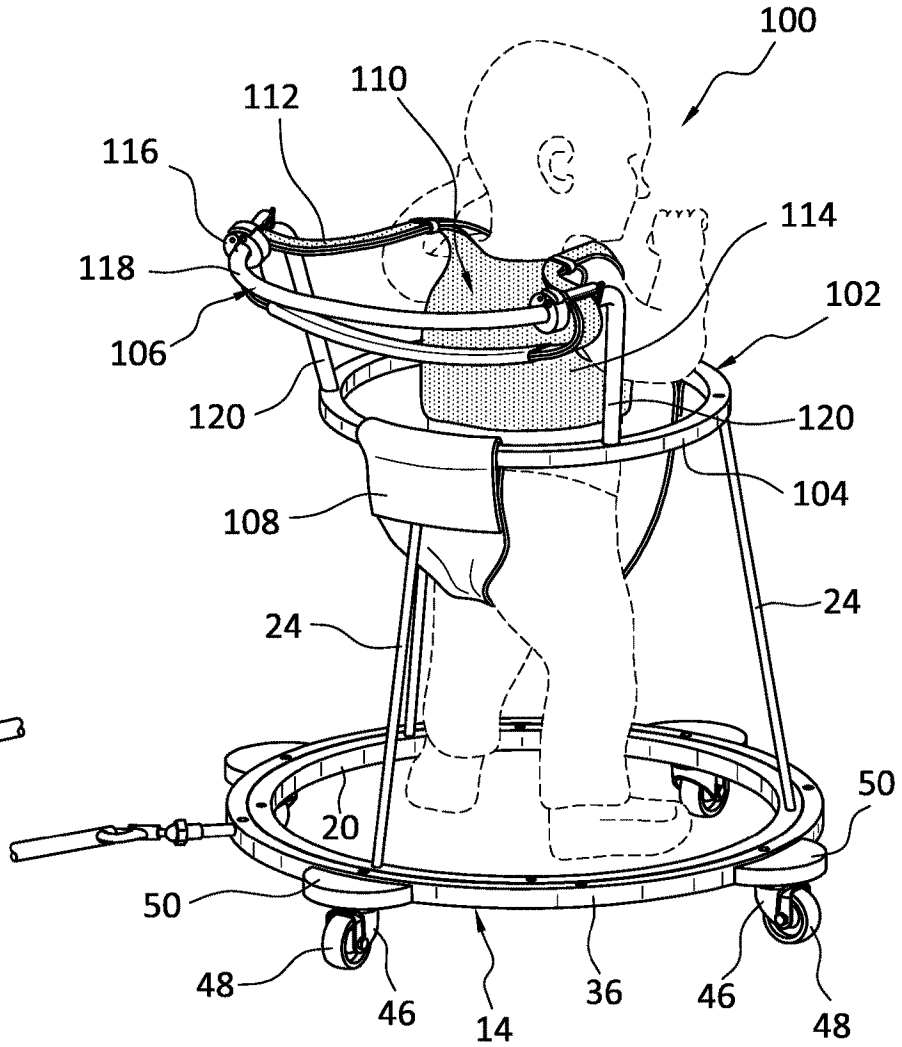
FIG. 17 is a rear view of the embodiment shown in FIG. 15.

FIGS. 15 and 16 show an embodiment with an alternative clamp 116 (also seen in FIG. 17). In this embodiment, the clamp 116 comprises a C-shaped member 152 that is closed by a locking bar 154. Locking bar 154 is opened to allow insertion of part of the handle 112 between the C-shaped member 152 and the bar portion 118, and then locking bar 154 is actuated to secure the handle 112 (this position being best seen in FIG. 16). The C-shaped member 152 and locking bar 154 may be configured as a spring clamp.

In one embodiment, it is possible to eliminate use of the clamps 116, in which case, the handle 112 of the walking wings 110 may be secured to the retaining structure 106, by for example, looping the handle 112 around the bar portion 118 and then tying it to itself and/or to the bar portion 118.

Figure 18:
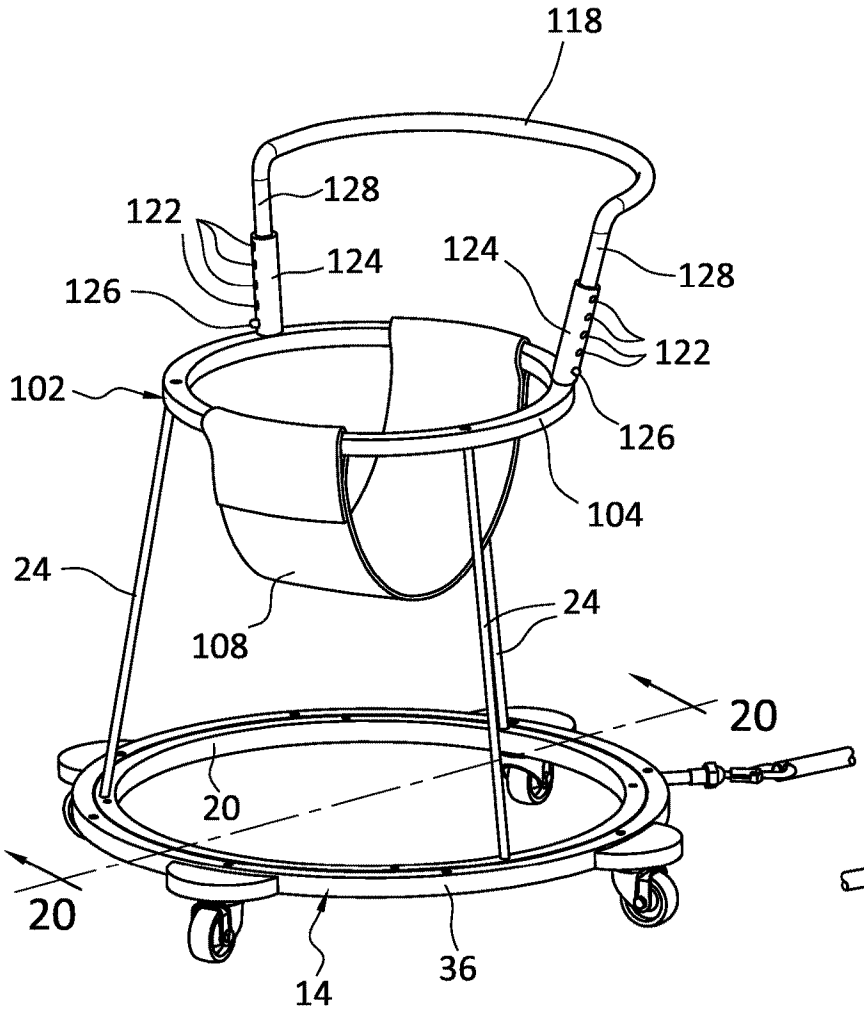
FIG. 18 is a front view of the embodiment shown in FIG. 11 with an alternative retaining structure.

FIG. 18 shows a variant of the retaining structure 106 which is adjustable in height relative to the upper support rim 104. Numerous different techniques to provide for this height adjustability are possible and all are envisioned as being within the scope and spirit of the invention. In the illustrated embodiment, the height adjustability is provided by forming a series of apertures 122 in a pair of tubes 124 extending upward from the upper support rim 104, and a press button 126 on each of a pair of tubes 128 that are respectively sildable within one of the tubes 124. Pressing buttons 126 on the tubes 128 inward allows a user to raise or lower the tubes 128 and connected bar portion 118 relative to the upper support rim 104 to a desired height. The desired height may be a height that properly positions the toddler with their feet just touching the substrate and not dragging on the substrate (see FIGS. 11, 13, 15 and 17). The height adjustment may also provide the parent to conveniently control the invention manually (without armature 16)

FIG. 19 shows the expansive degree of movement of the walker 100 when the armature 16 is attached to the stand 86 (and applies similarly to walker 10 described above). The walker 100 can move 360 degrees around the stand 86, and in each angular position around the stand 86, the toddler can move 360 degrees (represented by the curved arrows around the walker 100 in each position. Moreover, by virtue of the armature 16 being telescopable, in each position around the stand 86, the walker 100 can also move closer toward the stand 86 and farther away from the stand 86 (represented by the double-sided arrow alongside the armature 16 in each position). In all of these positions, the toddler is wearing the walking wings 110 without a parent or caregiver holding onto the harness or handle 112 of the walking wings 110.

The same wide range of possible movements indicated in FIG. 19 is also possible for walker 10.

Figure 20:
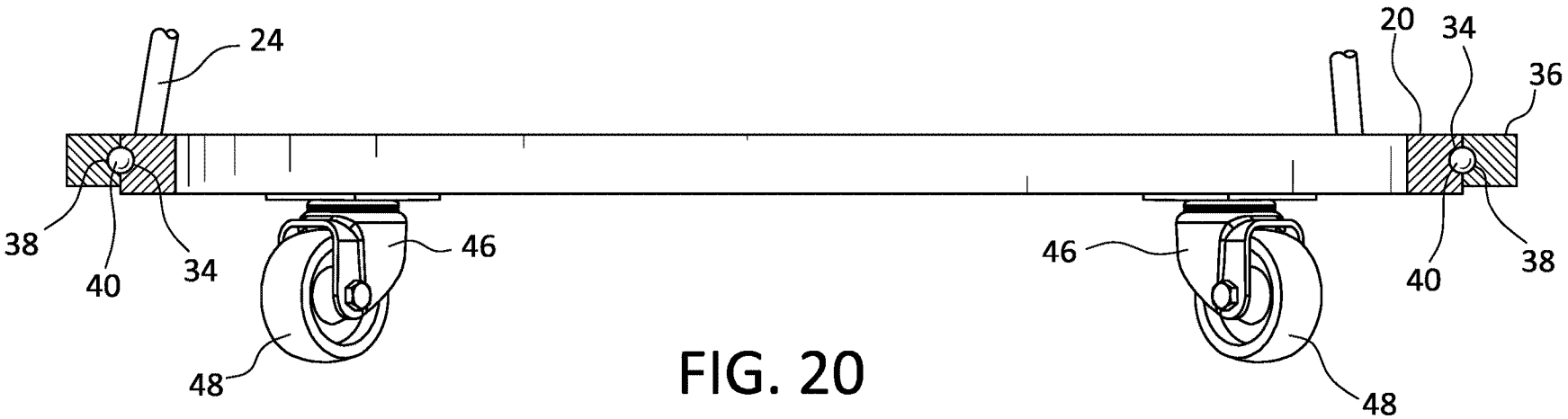
FIG. 20 is a cross-sectional view taken along the line 20-20 of FIG. 18.

The wide ranging movement is facilitated by the caster assemblies 46 with wheels 48 as shown in FIG. 20.

Figure 22:
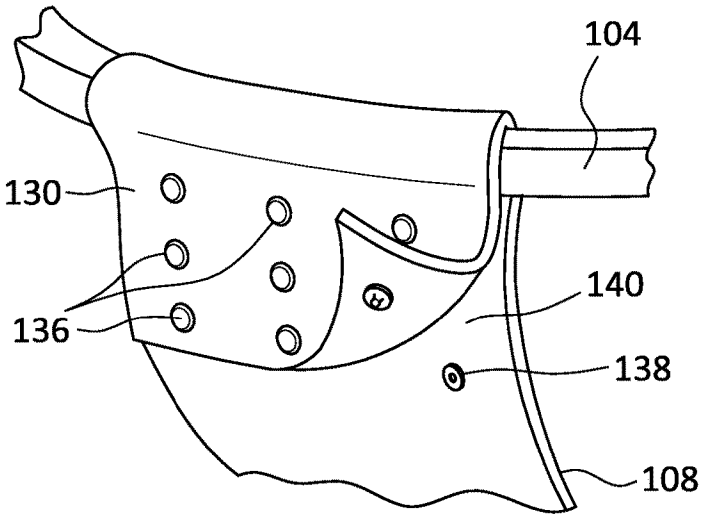
FIG. 22 is a view of another embodiment of a positioning member for the embodiments shown in FIGS. 11 and 15.
Figure 21:
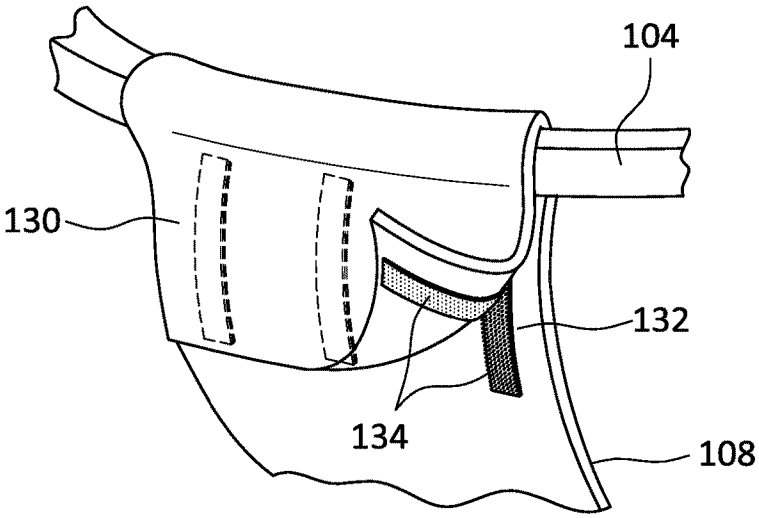
FIG. 21 is a view of one embodiment of a positioning member for the embodiments shown in FIGS. 11 and 15.

FIGS. 21 and 22 shows two different structures to attach the positioning member 108 to the upper support rim 104. In FIG. 21, hook and loop fasteners 134, e.g., of the VELCRO™ type, are arranged on each end region 130 of the positioning member 108 and another portion 132 of the strap 108 that will be opposite the end region 130 when the positioning member 108 is folded over the upper support rim 104. The positioning member 108 is adjustable by altering the engagement of the hook and loop fasteners.

In FIG. 22, a plurality of rows of snaps 136 are arranged on end region 130 and a single row of mating snaps 138 is arranged on another portion 140 of the positioning member 108 that will be selectively opposite the end region 130 when the positioning member 108 is folded over the upper support rim 104. The positioning member 108 is adjustable by altering the engagement of one of the rows of snaps 136 to the row of snaps 138.

It is imperative to appreciate that hook and loop fasteners and snaps are only described as examples of the types of attachment means that may be used to attach each end region of the positioning member 108 to the upper support rim 104. Other attachment mechanisms are envisioned. Furthermore, while not shown, it is also possible to provide a wider positioning member 108 with slot openings for placement of the toddlers legs further insuring safety provision. In other words, a wider slot may have two apertures 30 with a middle section 32 therebetween (see FIG. 2)

There are significant advantages of walker 100 when used with conventional walking wings 110. For example, in use of walker 100 with conventional walking wings, it is not necessary that a parent guides the toddler who is wearing the walking wing 110 but rather, the toddler is retained by engagement of the walking wings 110 with the toddler retainer 102. Once supported, the toddler is substantially standing up and may be on the brink of walking or already walking on their own. The parent does not have to hold a "leash" on the toddler. Rather, this "leash" is attached to the retaining structure 106 and secured thereto, e.g., by a clamp or lock.

Additionally, walker 100 provides a better, safer improvement of learning devices that will give the parent or caregiver confidence their toddler will not in any way be subjected to possible injury by moving the walker to a dangerous location or area. The height adjustment may also provide the parent to conveniently control the invention manually (without armature 16)

It is also possible to retrofit an existing walker to include the retaining structure 106. For example, the retaining structure 106 may be constructed with the support portions 120 having their lower ends with securing mechanisms to secure to the upper support rim of an existing baby walker. A snap-in type of connection may be used. A clamp may be provided in a retrofit kit to slip around the upper support rim of an existing walker and mate with the lower ends of the support portions 120. The modified baby walker would be used in the same manner as walker 100.

The retaining structure 106 is not limited to the shape and form of the illustrated embodiment, it is contemplated by the inventor that the retaining structure 106 may have many different forms to adapt to the different styles of harness and handles of existing walking wings. Different securing mechanism may be used, or possibly no securing mechanism at all if the harness or handle of the walking wings is conducive to being draped over and tied or otherwise secured without additional structure to the retaining structure 106.

As to specifics of the materials used, the use of a "lazy susan" type assembly to provide for the relative rotation between the toddler retainer 12, 102 and the substrate support 20 is an example of a commonly known and usable mechanism to provide for this relative rotation. A commercially available 20 inch aluminum "lazy susan" mechanism may be easily obtained. Alternatively, a 24 inch or 28 inch could be used. The specific size may be determined by the size of the walker 10, 100. Identification of the possible use of a "lazy susan" type mechanism in the invention is not intended to limit the invention is any manner whatsoever. Any other mechanism that provides two members that enable one member to rotate 360 degree relative to the other, whether rings or other shaped members, may be used. Ideally, a smooth and easy rotation should be provided since the toddler is the one initiating such rotation and it is highly desirable to enable the toddler to turn without being assisted by the movement of the caster assemblies 46.

The embodiment of the invention described above with reference to FIGS. 1-10 and the embodiments of the invention described above with reference to FIGS. 11-22 share a significant number of components. As such, it is possible and contemplated to construct a walker and system including the same in accordance with the invention with interchangeable components to enable conversion from the embodiment shown in FIGS. 1-10 to any one of the embodiments shown in FIGS. 11-22. A kit can be provided with all of the components and instructions to inform the parent how to assemble a first subset of the components to provide the walker of FIGS. 1-10 and how to assemble a second subset of the components different than the first subset to provide any of the walkers of FIGS. 11-22. The parent might configure the components to provide the embodiment of FIGS. 1-10 when the toddler is first learning to walk and then reconfigure it to any of the walkers shown in FIGS. 11-22 when the toddler is progressing in their walking. A walker may even be configured to have all of the components and the parent provided with instructions for use of the walker in any of the different ways disclosed above, again, possibly starting with a configuration like in FIGS. 1-10 and then progressing to a configuration like in any of FIGS. 11-22.

The invention may therefore also be considered like a modular system wherein different modules are provided or assembled based on the stage of learning to walk of the intended user of the system.

Figure 23:
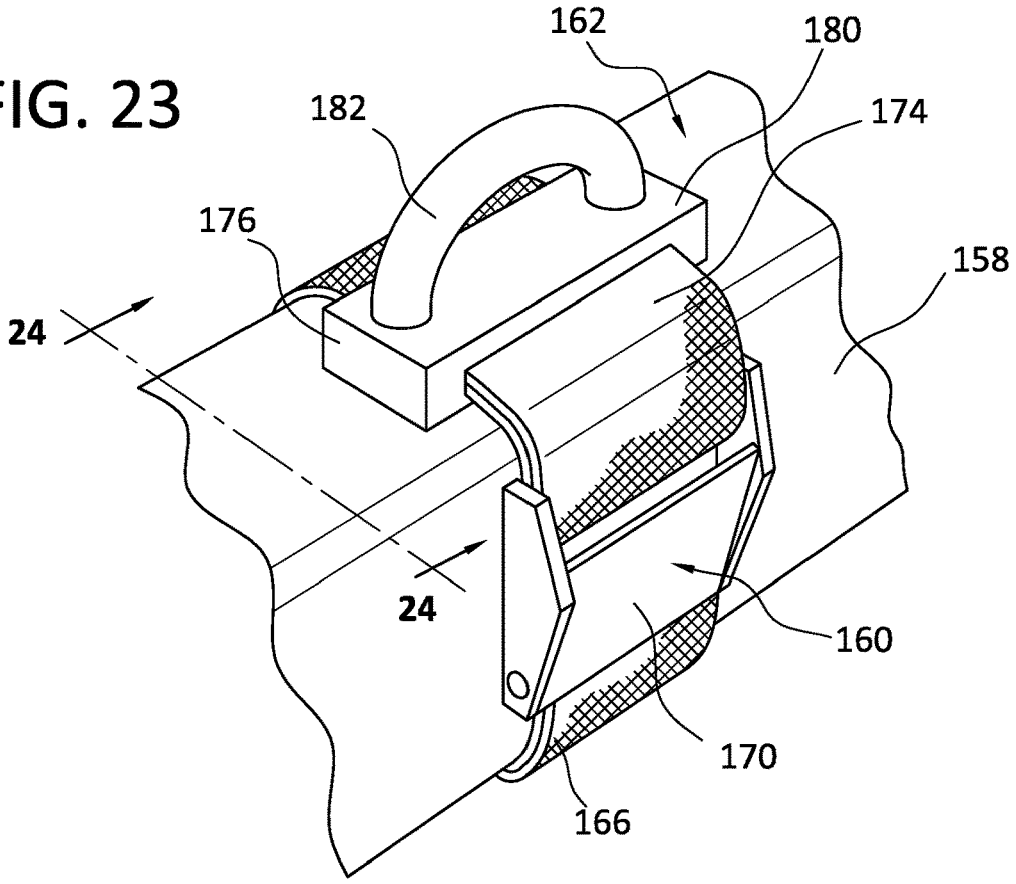
FIG. 23 is a view of a coupler that enables an armature of the invention to be coupled to any walker including conventional walkers, shown coupled to a part of a conventional walker.
Figure 24:
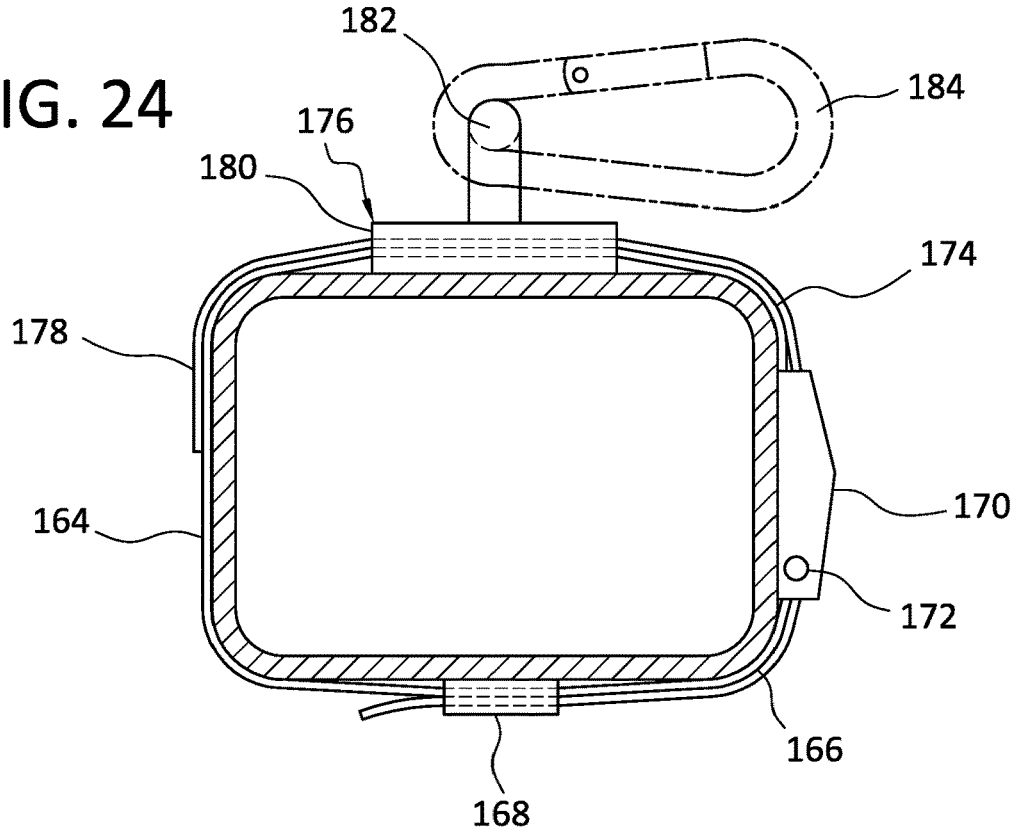
FIG. 24 is a cross-sectional view of the coupler shown in FIG. 23 taken along the line 24-24 in FIG. 23 and also showing a carabineer as an example of a possible attachment between the coupler and the armature of the invention.

Referring now to FIGS. 23 and 24, an movement limiting system for existing baby walkers is also considered to be part of the invention, both alone and in combination with the existing baby walker. Using the movement limiting system, a conventional walker having a unitary toddler retainer and substrate support may be used with the armature 16, this combination of a conventional walker and armature 16 being considered a learn-to-walk system in accordance with the invention, also optionally with the stationary object 18, such as the stand 86. By providing armature 16 that telescopes to provide variable lengths and a coupler that attaches one end of the armature 16 to the conventional walker, advantages can still be obtained, e.g., imposing a movement limitation on the walker.

Although there are numerous possible couplers that may be used to connect the end region 52 of the armature 16 to a part of an existing walker, one particular embodiment is shown in FIGS. 23 and 24. The term coupling means as used herein encompasses any structure that couples the end region 52 of the armature 16 to the walker including the disclosed coupler and variants of the disclosed coupler and any other similar, equivalent or comparable structure that securely attaches to a part of the walker and to the end region 52 of the armature 16. The disclosed coupler or coupling means may be formed on the armature 16 and/or on the walker and/or as part of a component separable from the armature 16 and walker (as is the coupler of FIGS. 23 and 24). These coupling means do not require that there is swiveling of the substrate support 14 relative to the end region 52 of the armature 16. Rather, the coupling means may provide for a fixed connection of the end region 52 of the armature 16 to the walker, in which case, the walker is permitted to move in the longitudinal direction of the armature 16, when the armature 16 is in a horizontal plane of use. The coupling means therefore include the clasp component 76 disclosed above.

FIGS. 23 and 24 show a coupler 160 that is designed to surround a support portion 158 of a conventional walker 162. This support portion 158 may be the generally horizontal rim at the bottom of the conventional walker 162, right above the caster assemblies or wheels. Most if not all conventional walkers have such a support portion, although the cross-sectional shape may vary. As such, the coupler 160 is designed to allow it to engage with or grasp support portions with different cross-sectional shapes.

To this end, coupler 160 includes a strap 164 with a loop 166 at one end that is secured in a holder 168 and which loop 166 passes around a first pin 172 of a buckle 170. Strap 164 also includes a second loop 174 at an opposite end that is secured in an anchor element 176. Loop 174 passes around a second pin of the buckle 170. The free end 178 of the strap 164 passes through the anchor element 176 and is adjusted to tighten the coupler 160 to the support portion 158 of the walker 162. The free end 178 is therefore movable relative to the anchor element 176. The other portion of the strap 164 that passes through the anchor element 176 may be fixed thereto or movable relative thereto. A passage may be formed in the anchor element 176 to allow for passage of the portions of the strap 164 therethrough. The coupler 160 therefore has an open state in which it is positionable around the support portion 158 and a closed state in which it is secured to the support portion 158.

The strap 164 is tightened around the support portion 158 of the walker 162 in a conventional manner. Initially, the buckle 170 is opened in the sense that the loop 174 is not formed and the strap 164 extends from the anchor element 176 without engaging the buckle 170. The coupler 160 is placed around the support portion 158 with the anchor element 176 on the top as shown, although placement on the outer side is also a possibility. The free end 178 of the strap 164 is then passed around the pin of the buckle 170, then passed through the anchor element 176 and pulled to tighten the anchor element 176 against the support portion 158. The buckle 170 is closed to secure the strap 164 in the tightened state. Depending on the construction of the coupler 160, it is also possible to first close the buckle 170 and then tighten the strap 164. Regardless of how it is achieved, in the final state, the buckle 170 is closed and the strap 164 is tightened around the support portion 158 with the anchor element 176 is a position on the top or an outer side of the support portion 158. The buckle 170 therefore has an open state in which the strap 164 can be positioned around the support portion 158 and a closed state in which the strap 164 can be tightened to secure the anchor element 176 to the support portion 158, preferably on a top or outer side.

Anchor element 176 includes a base portion 180 and a loop 182 extending from the base portion 180. Loop 182 may be a semi-circular shape and extend sufficiently apart from the facing surface of the base portion 180 to allow for a clip 184 to attach to the loop 182 (see FIG. 24). The clip 184 may be in the form of a carabineer. Other types of clips may be used. The clip 184 may be positioned around an aperture at the end region 52 of the armature 16.

The clip 184 is attached to the armature 16. This attachment may be a permanent fixing of the clip 184 to the armature 16 or a releasable attachment. In the latter case, the end region of the armature 16 may be provided with a hook and the clip 184 attached to this hook. The manner in which the armature 16 is attached to the loop 182 is not critical to the invention. It is even possible to provide for a fixed attachment of the loop 182 to the armature 16.

By providing the coupler 160 at the end region of the armature 16, is becomes possible to attach the armature 16 to almost any conventional walker 162. A baby would be placed into the conventional walker 162 in the normal manner, and the coupler 160 attached to the support portion 158. The armature 16, when connected to the coupler 160, enables the walker 160 to move relative to the stationary object 18, e.g., the stand 86, within the movement parameters defined by setting of the armature 16.

In this scenario, a kit including the armature 16 and the coupler 160 could be sold as a unit, optionally along with the stand 86 and directions for attachment of the coupler 160 to their walker, attachment of the armature 16 to the coupler 160 is necessary, and attachment of the armature 16 to the stationary object 18, e.g., the stand 86 if included or other mounting bracket attached to, for example, a wall. The kit could also include such a mounting bracket instead of a stand 86. The purchaser could then use the learn-to-walk system in accordance with the invention with their own walker, by having the advantage of limited movement of the walker relative to a stationary object.

The coupling means are therefore situated at the end region of the armature 16 that connects to the walker 162, and as such, the walker end region of the armature 16 is configured to or includes any one of a number of different couplers or adapters, for example, a clip, a strap, a ring with an opening and button to open/close the opening, and the like.

Coupler 160 is considered an adequate universal adapter because the tightening strap 164, preferably a flexible webbing polyester tie down strap, with the buckle 170 of similar cam lock can affix to most or all baby walkers. A sliding keyhole metal part could be used as a quick connect or quick disconnect of the elongate armature 16 (telescoping pole). An exemplifying, non-limiting kit would include the 3 or 4 section pole (depending on the reach), the flexible cam- lock strap or buckle 170, the wall mounting bracket (preferably at the baseboard location) with four screws and one or two stainless steel 1.8 inch pad eye plate U-hooks, four screws and two- piece stainless steel snap hook (see attached). The spring snap hooks can go on both ends of the elongated armature 16 and quick connect to the eye plate U-hook on the baseboard (preferably) and to the special attachment on the strap 164 tightly attached to the baby walker.

The cam-lock adjustable polyester tie-down strap 164 is designed to ideally fit all irregular areas from the myriad of baby walker manufacturers, e.g., Fisher Price, Safety 1st, Grayco, Baby Einstein, Joovy, Kolcraft, etc. The strap 164 would ideally have the quick connect/disconnect attachment to the armature 16. Once tightened, the strap 164 could remain in place. Small wall mount brackets could remain on baseboards of a room to hook the elongate armature's first and second opposite end regions to the tie down strap 164 and to the wall or floor substrate. The tightening strap 164 can affix to all side or back supports on the support platform of the baby walker above the wheels or casters. Keeping the elongate armature 16 low and parallel to the horizontal surface on which the baby walker is situated is advantageous While most, or all, of the existing baby walkers so retrofitted will have less range of movement and turns than system 8 (since walker 10 is not used), this retrofit attachment link from the walker to a flat surface wall, or a fixed mounted wall bracket, or a floor-mounted object whereby the unit revolves around a pole, would limit the range and provide the parent and caregiver with safety limits and thus reduce serious accidents.

As such, although a retrofit of a conventional walker is obviously not as advantageous as walker 10 in that there is no relative rotation between the toddler retainer and the substrate support; nevertheless, some advantages are obtained by the variable-length armature 16 serving to limit movement of the walker.

A modification of any of the walkers disclosed herein is to install a stop onto the walker, e.g., as disclosed in one or more of U.S. Pat. Nos. 5,371,922, 5,727,800, 6,352,234, 7,055,836 and 9,107,513. When such a stop is attached to walker in which the toddler retainer and substrate support rotate or swivel relative to one another, e.g., walker 10 described above, the walker 10 could be fixed in position yet still allow the toddler to rotate 360 degrees. The substrate support 14 would remain fixed in position while the toddler retainer 12 can rotate relative to the substrate support 14 and enable the toddler to rotate 360 degrees while keeping the walker 10 in position. Such a stop is either manually controlled to engage with the surface below the walker 10 or controlled by foot, between the fixing position and a released position which enables movement along the surface.

As shown in several of the drawings herein, the armature 16 may be used in a state wherein it is in a horizontal plane. For example, in the embodiment of FIG. 1, the ring or loop 92 is positioned on the pole 90 to be at substantially the same height as the support portion of the toddler retainer 12 and substrate support 14. This horizontal orientation of the armature 16 provides for easy extension and retraction of the elongate sections of the armature 16.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A movement limiting system for a walker that limits movement of the walker, comprising:

an elongate, adjustable length armature having first and second opposite end regions; and coupling means for coupling said first end region of said armature to the walker, said coupling means comprising a projection and a clip connecting said projection to said first end region of said armature, said clip being removable from engagement with at least one of said projection and said first end region of said armature;

whereby when said second end region of said armature is coupled to an object, said walker is limited in its movement relative to the object by said armature.

2. The system of claim 1, further comprising attachment means at said second end region of said armature for coupling said armature to the object.

3. The system of claim 1, wherein said armature comprises a plurality of sections that telescope relative to one another to provide said armature with an adjustable length.

4. The system of claim 1, wherein said coupling means comprise a coupler having a portion configured to surround a support portion of the walker, said projection being situated on said coupler.

5. The system of claim 4, wherein said coupler comprises an anchor element on which said projection is situated.

6. The system of claim 1, wherein said coupler further comprises a buckle, and a strap having a first end region engaging with said buckle and a second end region opposite the first end region engaging with said buckle, said buckle having an open state in which said strap is positionable around the support portion and a closed state in which said strap is secured around the support portion.

7. The system of claim 6, wherein said coupler further comprises an anchor element on which said projection is situated and said anchor element is secured to said strap in a position on a top or outer side of the support portion when said buckle is in the closed state.

8. The system of claim 1, further comprising:

a stand including a base and a pole extending upward from said base, said stand constituting the object; and a ring or loop at said second end region of said armature and that engages with said pole to secure said armature to said pole.

9. The system of claim 1, further comprising:

a bracket attachable to a wall, the wall constituting the object; and a ring or loop at said second end region of said armature and that engages with said bracket to secure said armature to the wall when said bracket is attached to the wall.

10. A movement limiting system for a walker that limits movement of the walker, comprising:

an elongate, adjustable length armature having first and second opposite end regions;

a coupler having a portion configured to surround a support portion of the walker and which couples said first end region of said armature to the walker, said coupler comprising a projection and a clip connecting said projection to said first end region of said armature, said clip being removable from engagement with at least one of said projection and said first end region of said armature; and attachment means at said second end region of said armature for coupling said armature to an object, whereby when said second end region of said armature is coupled to the object by said attachment means, said walker is limited in its movement relative to the object by said armature.

11. The system of claim 10, wherein said armature comprises a plurality of sections that telescope relative to one another to provide said armature with an adjustable length.

12. The system of claim 10, wherein said coupler further comprises an anchor element on which said projection is situated.

13. The system of claim 10, wherein said coupler further comprises a buckle, and a strap having a first end region engaging with said buckle and a second end region opposite the first end region engaging with said buckle, said buckle having an open state in which said strap is positionable around the support portion and a closed state in which said strap is secured around the support portion.

14. The system of claim 13, wherein said coupler further comprises an anchor element on which said projection is situated and said anchor element is secured to said strap in a position on a top or outer side of the support portion when said buckle is in the closed state.

15. The system of claim 10, further comprising:

a stand including a base and a pole extending upward from said base, said stand constituting the object; and a ring or loop at said second end region of said armature and that engages with said pole to secure said armature to said pole.

16. The system of claim 10, further comprising:

a bracket attachable to a wall, the wall constituting the object; and a ring or loop at said second end region of said armature and that engages with said bracket to secure said armature to the wall when said bracket is attached to the wall.

17. A kit for a walker to limit movement of the walker, comprising:

an elongate, adjustable length armature having first and second opposite end regions;

a coupler having a portion configured to surround a support portion of the walker and which couples said first end region of said armature to the walker, said coupler comprising a projection and a clip connecting said projection to said first end region of said armature, said clip being removable from engagement with at least one of said projection and said first end region of said armature;

a bracket attachable to a wall; and a ring or loop at said second end region of said armature and that engages with said bracket to secure said armature to the wall when said bracket is attached to the wall, whereby when said second end region of said armature is coupled to the wall by said ring or loop and said bracket, said walker is limited in its movement relative to the wall by said armature.

18. A movement limiting system for a walker that limits movement of the walker, comprising:

an elongate, adjustable length armature having first and second opposite end regions; and a coupler that couples said first end region of said armature to the walker, said coupler comprising a buckle, and a strap having a first end region engaging with said buckle and a second end region opposite the first end region engaging with said buckle, said buckle having an open state in which said strap is positionable around a portion of the walker and a closed state in which said strap is secured around the portion of the walker;

whereby when said second end region of said armature is coupled to an object and said buckle is in the closed state with said strap secured around the portion of the walker, said walker is limited in its movement relative to the object by said armature.

19. The system of claim 18, further comprising attachment means at said second end region of said armature for coupling said armature to an object, whereby when said second end region of said armature is coupled to the object by said attachment means, said walker is limited in its movement relative to the object by said armature.

20. The system of claim 18, wherein said coupler further comprises an anchor element on which said projection is situated and said anchor element is secured to said strap in a position on a top or outer side of the portion of the walker when said buckle is in the closed state.

* * * * *